US007740081B2

(12) United States Patent
Edwards et al.

(10) Patent No.: US 7,740,081 B2
(45) **Date of Patent: *Jun. 22, 2010**

(54) HAZARD DETECTION AND SUPPRESSION APPARATUS

(75) Inventors: Richard H. Edwards, Germantown, TN (US); Brandon N. Reed, Holt, MO (US); Robert Wayne Green, Memphis, TN (US)

(73) Assignee: TSM Corporation, Bartlett, TN (US)

( * ) Notice: Subject to any disclaimer, the term of this patent is extended or adjusted under 35 U.S.C. 154(b) by 127 days.

This patent is subject to a terminal disclaimer.

(21) Appl. No.: 11/879,328

(22) Filed: Jul. 16, 2007

(65) Prior Publication Data

US 2008/0289834 A1 Nov. 27, 2008

Related U.S. Application Data

(63) Continuation-in-part of application No. 11/807,074, filed on May 25, 2007.

(51) Int. Cl.
*A62C 37/10* (2006.01)
*A62C 3/07* (2006.01)
*A62C 37/00* (2006.01)

(52) U.S. Cl. ..... 169/60; 169/56; 169/62; 137/68.3; 340/286.05; 340/628; 340/629

(58) Field of Classification Search ..... 169/62, 169/65, 60; 137/68.3; 340/286.05, 628, 340/629

See application file for complete search history.

(56) References Cited

U.S. PATENT DOCUMENTS 3,399,728 A 9/1968 Taylor
3,762,479 A * 10/1973 Fike et al. ..... 169/28
3,853,180 A 12/1974 Harris et al.
3,915,235 A * 10/1975 Hamilton et al. ..... 169/28
3,915,237 A 10/1975 Rozniecki et al.

(Continued)

FOREIGN PATENT DOCUMENTS

WO WO 03/072200 A1 9/2003

OTHER PUBLICATIONS

Maxim Integrated Products, Maxim MAX1606 28V Internal Switch LCD Bias Supply with True Shutdown (2000), pp. 1-10 (Maxim Integrated Products; Sunnyvale, California, USA).

(Continued)

*Primary Examiner*—Dinh Q Nguyen
*Assistant Examiner*—Justin Jonaitis
(74) *Attorney, Agent, or Firm*—McKenzie & Walker, P.C.

(57) ABSTRACT

A hazard detection and suppression apparatus and a single-action discharge valve for discharging a vessel's contents. The valve has a valve body with a passage therethrough through which the contents are discharged, a frangible seal held within the valve body and sealing the passage while the seal is intact, and a solenoid including an armature moveable from a first to a second position. A thermopile or a thermopile matrix senses near-infrared energy to detect a fire hazard and actuate the valve. Amplifiers for the thermopile's signal are monitored for failure. A thermostat or a manual pushbutton can also actuate the valve, and an operator's panel monitors failure conditions. Other hazard detectors may be used including a petroleum detector, a chemical sensor, a moisture detector, a radiation detector, a gas detector, and a moving body detector.

12 Claims, 15 Drawing Sheets

U.S. PATENT DOCUMENTS

| | | | | |
|---|---|---|---|---|
| 3,983,892 | A | 10/1976 | Hardesty | |
| 4,006,780 | A | 2/1977 | Zehr | |
| 4,423,326 | A | 12/1983 | Ball | |
| 4,436,159 | A | 3/1984 | Revay | |
| 4,532,997 | A * | 8/1985 | Atherton et al. | 169/56 |
| 4,692,752 | A * | 9/1987 | Abel | 340/604 |
| 4,830,052 | A | 5/1989 | Oberlin et al. | |
| 4,893,680 | A | 1/1990 | Wittbrodt et al. | |
| 5,010,911 | A | 4/1991 | Grant et al. | |
| 5,053,752 | A | 10/1991 | Epstein et al. | |
| 5,059,953 | A | 10/1991 | Parsons et al. | |
| 5,075,550 | A | 12/1991 | Miller et al. | |
| 5,188,182 | A * | 2/1993 | Echols et al. | 166/376 |
| 5,299,592 | A | 4/1994 | Swanson | |
| 5,458,202 | A * | 10/1995 | Fellows et al. | 169/58 |
| 5,470,043 | A | 11/1995 | Marts et al. | |
| 5,691,704 | A | 11/1997 | Wong | |
| 5,808,541 | A * | 9/1998 | Golden | 340/286.05 |
| 5,918,681 | A | 7/1999 | Thomas | |
| 6,138,768 | A * | 10/2000 | Fujiki | 169/30 |
| 6,164,383 | A | 12/2000 | Thomas | |
| 6,184,980 | B1 | 2/2001 | Brown et al. | |
| 6,189,624 | B1 | 2/2001 | James | |
| 6,619,404 | B2 | 9/2003 | Grabow | |
| 6,657,731 | B2 | 12/2003 | Tapalian et al. | |
| 6,819,237 | B2 | 11/2004 | Wilson et al. | |
| 6,832,507 | B1 | 12/2004 | van de Berg et al. | |
| 6,907,940 | B1 | 6/2005 | Ahlers | |
| 7,115,872 | B2 | 10/2006 | Bordynuik | |
| 7,117,950 | B2 | 10/2006 | McLane, Jr. | |
| 7,232,512 | B2 | 6/2007 | Tice | |
| 7,242,789 | B2 | 7/2007 | Takayasu et al. | |
| 2005/0011552 | A1 | 1/2005 | Sundholm | |
| 2005/0210894 | A1 * | 9/2005 | Hirota | 62/149 |
| 2007/0044979 | A1 | 3/2007 | Popp et al. | |

OTHER PUBLICATIONS

Analog Devices, ADG752 CMOS, Low Voltage RF/Video, SPDT Switch (1999), pp. 1-8 (Analog Devices, Inc.; Norwood, Massachusetts, USA).

Airpax Corporation, 5004 Series Thermostat (1999), pp. 1-4 (Airpax Corporation; Frederick, Maryland, USA).

Spectrum Associates, Inc., S2380 Pressure Switch (1981) (Spectrum Associates, Inc.; Milford, Connecticut, USA).

Dexter Research Center, Inc., Model ST60 & ST60R Silicon Based Thermopile Detector (2003) pp. 33-36 (Dexter Research Center, Inc.; Dexter, Michigan, USA).

Dexter Research Center, Inc., Introduction to Thermopile Detectors (May 2006) pp. v-vi (Dexter Research Center, Inc.; Dexter, Michigan, USA).

Dexter Research Center, Inc., Standard Optical Filters: Wide Band & Uncoated (Sep. 2006) pp. xvi-xvii (Dexter Research Center, Inc.; Dexter, Michigan, USA).

Dexter Research Center, Inc., SA32×32 Silicon Based Thermopile Imaging Array (Apr. 2006) pp. 3-7 to 3-9 (Dexter Research Center, Inc.; Dexter, Michigan, USA).

Dexter Research Center, Inc., SLA32 Silicon Based Thermopile Detector (Jul. 2006) pp. 3-3 to 3-5 (Dexter Research Center, Inc.; Dexter, Michigan, USA).

Dexter Research Center, Inc., Example Amplifier Circuits (2004) p. X (Dexter Research Center, Inc.; Dexter, Michigan, USA).

Dexter Research Center, Inc., Application Brief 1: A Simple DC Radiometer (Dec. 2006) pp. 1-3 (Dexter Research Center, Inc.; Dexter, Michigan, USA).

Analog Devices, OP281/OP481 Ultralow Power, Rail-to-Rail Output Operational Amplifiers (2003) pp. 1-15 (Analog Devices, Inc.; Norwood, Massachusetts, USA).

Carter, Bruce, & Brown, Thomas R., Handbook of Operational Amplifier Applications—Application Report SBOA092A (2001) p. 77 (Texas Instruments; Dallas, Texas, USA).

* cited by examiner

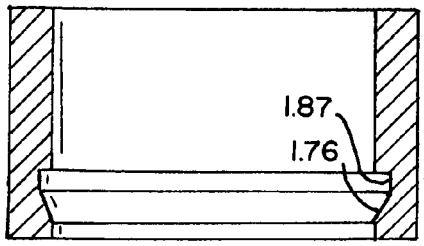
FIG. 3
FIG. 4
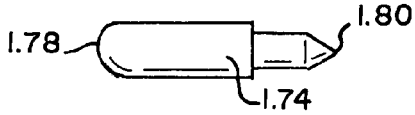
FIG. 5
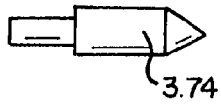
FIG. 6
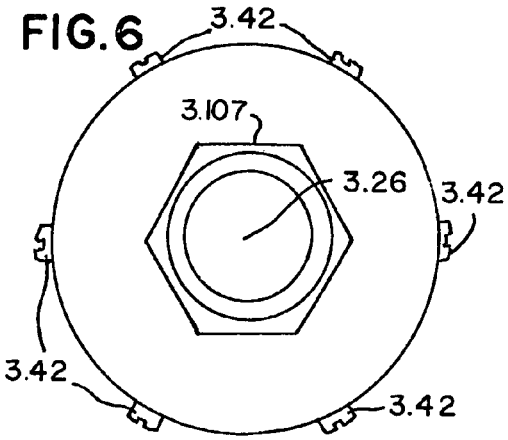
FIG. 7
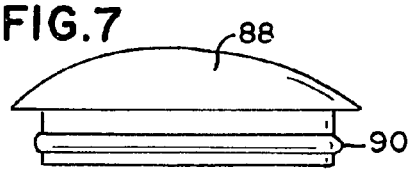
FIG. 8
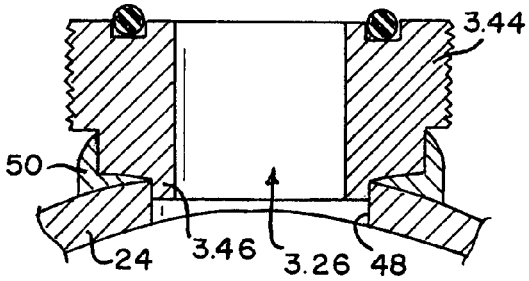
FIG. 9
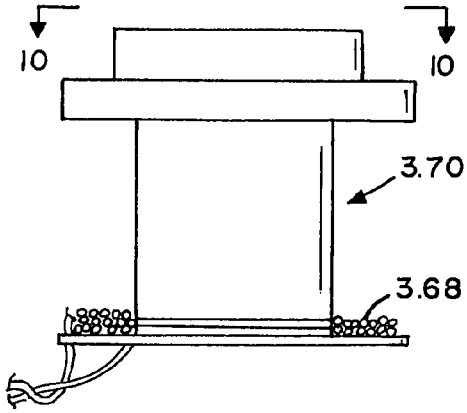
FIG. 10
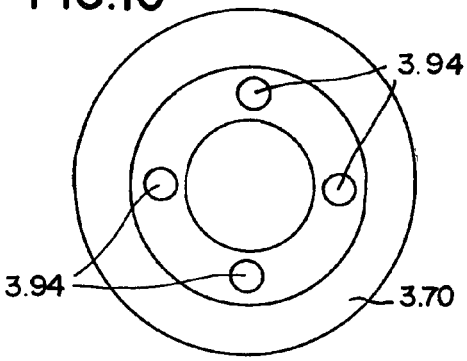
FIG. 11
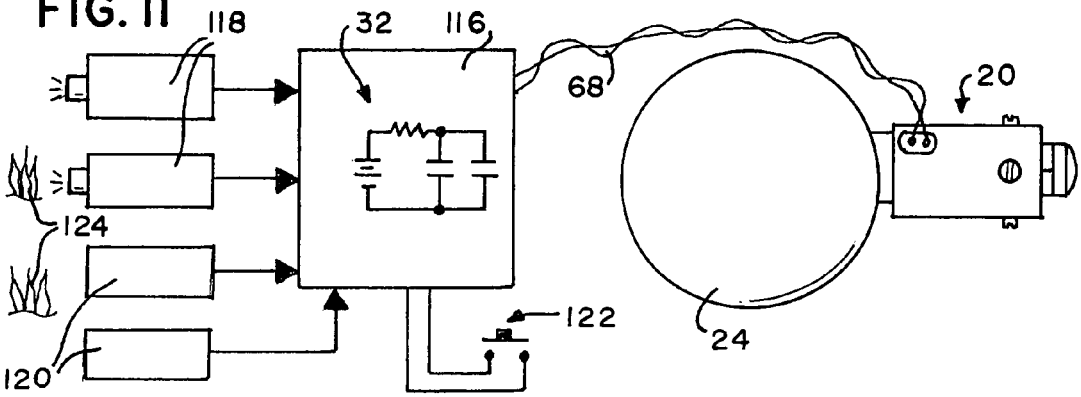

FIG. 19
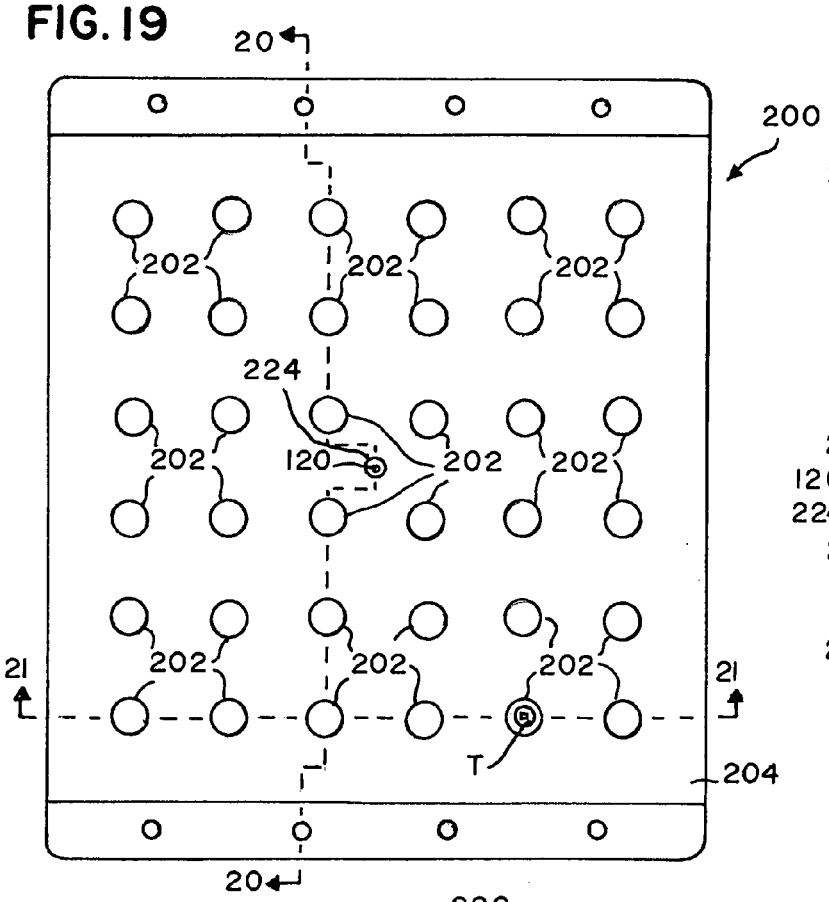
FIG. 20
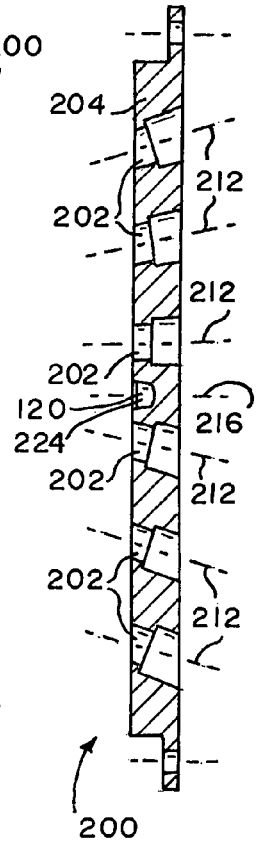
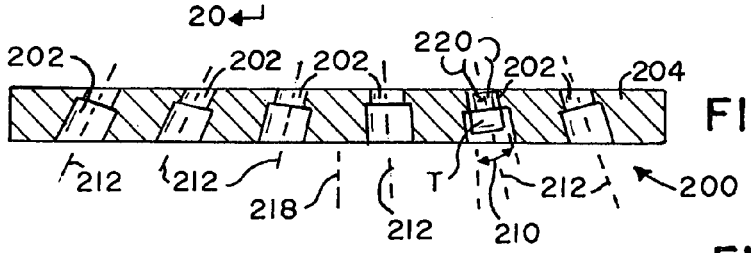
FIG. 21
FIG. 22
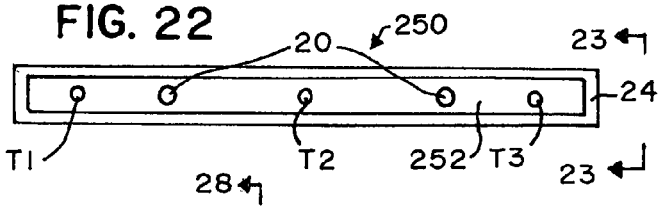
FIG. 23
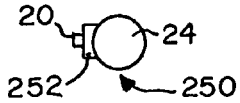
FIG. 24
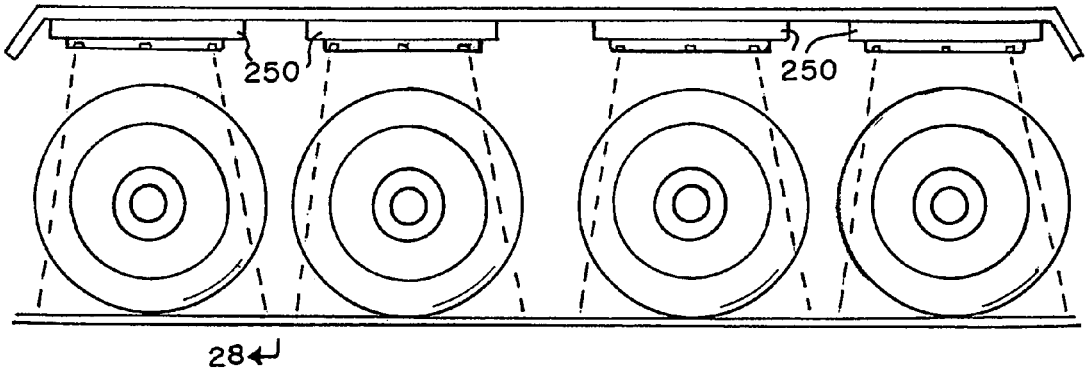

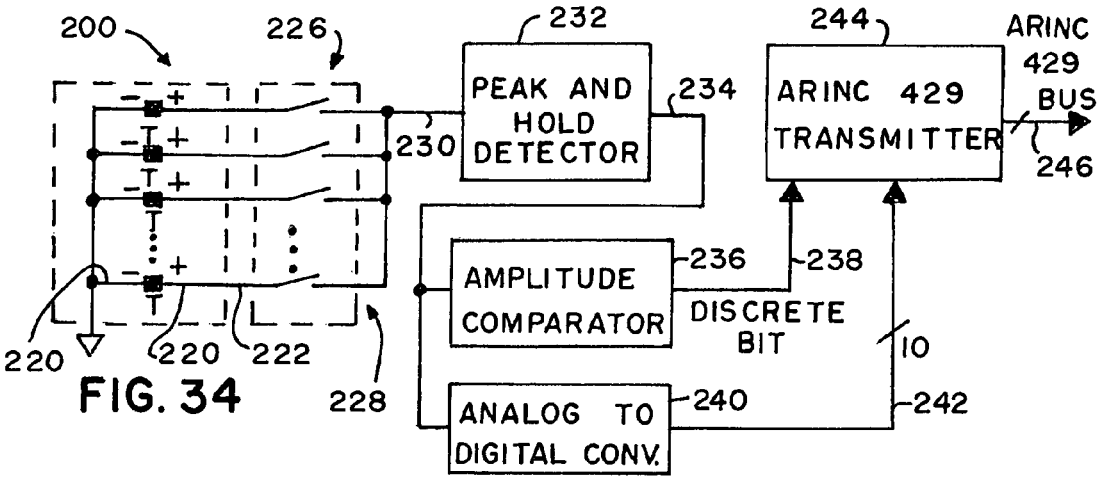
FIG. 34
FIG. 35
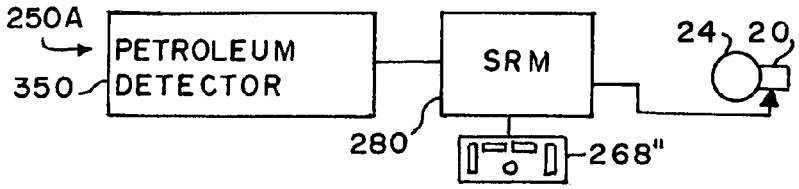
FIG. 36
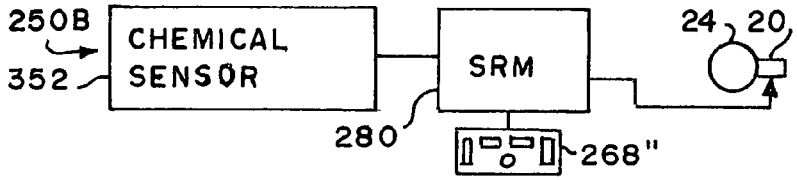
FIG. 37
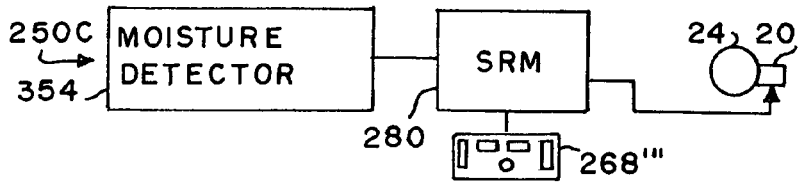
FIG. 38
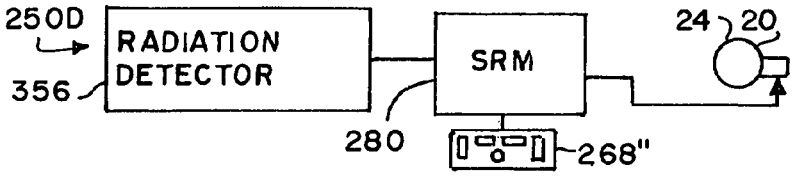
FIG. 39
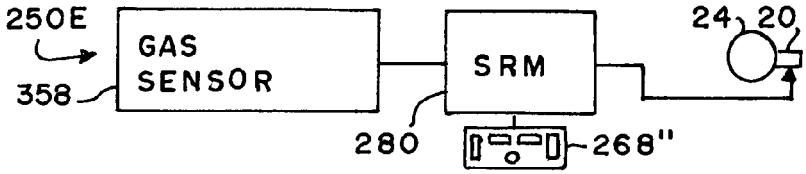
FIG. 40
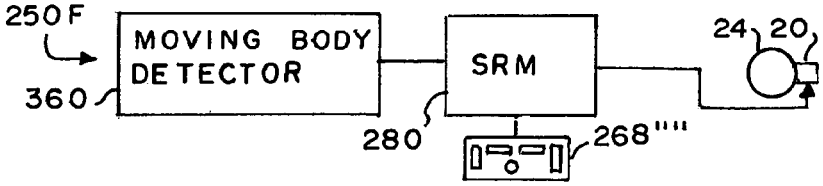

HAZARD DETECTION AND SUPPRESSION APPARATUS

CROSS REFERENCE TO RELATED APPLICATIONS

This application is a continuation-in-part of pending U.S. patent application Ser. No. 11/807,074, filed May 25, 2007, and entitled "Single-Action Discharge Valve", fully included by reference herein, and claims priority benefit thereof.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to hazard detection and suppression apparatus and to discharge valves for releasing gaseous, liquid, or dry material from a pressurized storage vessel, and in particular, to a hazard detection and suppression apparatus with a remotely-operated discharge valve for releasing material from a pressurized storage vessel.

2. Information Disclosure Statement

It is often desired to detect a hazard, such as a fire hazard, and to release a suppressant from a pressurized vessel to control or eliminate the hazard. A problem in the prior art is that such a hazard detection apparatus may fail and then become ineffective without providing an alert that the apparatus has failed. It is further often desired to provide a discharge valve to release a material, such as a gas or liquid or mixture thereof, or a dry material or powder, from a pressurized vessel when actuated by the hazard detection apparatus, and it is further desirable to have such a valve be remotely actuated. Often, the material to be released is corrosive and may corrode the internal components of the valve over time prior to actuation of the valve. Prior art approaches are known that use an explosive charge to cause a piston to drive a piercing element through a valve seal, and such approaches are undesirable if used with a flammable discharge material that might ignite.

It is therefore desirable to have a hazard detection and suppression apparatus that provides self-fail monitoring that can indicate when the apparatus has detected self failure. It is further desirable to provide a single-action discharge valve that can be remotely actuated to discharge the contents of a vessel under pressure when actuated by the hazard detection apparatus. It is further desirable that internal components of the valve not be exposed prior to actuation to the pressurized material to be released. Applications for such a valve include release of fire extinguishing material, release of counter-agents in biological and chemical warfare laboratories, and emergency release of fuel in airplanes and boats. When used for emergency release of fuel or other liquids, the valve can be used to discharge from a port on a bottom region of a vessel such as, for example, a fuel tank, and the weight of the liquid in the vessel provides pressure to discharge through the valve, and it is desirable that such a valve have a design that permits scaling from small to large sizes to accommodate a desired discharge rate.

A preliminary patentability search produced the following patents and patent publications, some of which may be relevant to the present invention: Sundholm et al., U.S. Patent Application publication 2005/011552, published Jan. 20, 2005; Harris et al., U.S. Pat. No. 3,853,180, issued Dec. 10, 1974; Rozniecki, U.S. Pat. No. 3,915,237, issued Oct. 28, 1975; Zehr, U.S. Pat. No. 4,006,780, issued Feb. 8, 1977; Thomas, U.S. Pat. No. 5,918,681, issued Jul. 6, 1999; Thomas, U.S. Pat. No. 6,164,383, issued Dec. 26, 2000; Ahlers, U.S. Pat. No. 6,107,940, issued Jun. 21, 2005; and McLane, Jr., U.S. Pat. No. 7,117,950, issued Oct. 10, 2006.

Additionally, the following patent references are also known: Hardesty, U.S. Pat. No. 3,983,892, issued Oct. 5, 1976; Ball, U.S. Pat. No. 4,423,326, issued Dec. 27, 1983; Wittbrodt et al., U.S. Pat. No. 4,893,680, issued Jan. 16, 1990; Parsons et al., U.S. Pat. No. 5,059,953, issued Oct. 22, 1991; Swanson, U.S. Pat. No. 5,299,592, issued Apr. 5, 1994; Marts et al., U.S. Pat. No. 5,470,043, issued Nov. 28, 1995; Brown, et al., U.S. Pat. No. 6,184,980, issued Feb. 6, 2001; James, U.S. Pat. No. 6,189,624, issued Feb. 20, 2001; Grabow, U.S. Pat. No. 6,619,404, issued Sep. 16, 2003; Tapalian, et al., U.S. Pat. No. 6,657,731, issued Dec. 2, 2003; van de Berg, et al., U.S. Pat. No. 6,832,507, issued Dec. 21, 2004; Bordynuik, U.S. Pat. No. 7,115,872, issued Oct. 3, 2006; Tice, U.S. Pat. No. 7,232,512, issued Jun. 19, 2007; Takayasu, et al., U.S. Pat. No. 7,242,789, issued Jul. 10, 2007; and BAE Systems PLC (Inventor: Goodchild), WIPO Publication No. WO 03/072200 A1, published Sep. 4, 2003.

Sundholm et al., U.S. Patent Application publication 2005/011552, at FIG. 2, discloses an explosive charge that propels a piercing element to pierce a disk, and FIG. 3 discloses a pressure-driven piston that causes a piercing element to pierce a disk. Harris et al., U.S. Pat. No. 3,853,180, discloses an explosive detonator that causes a pin to pierce a valve seal and release a fire-extinguishing medium under pressure. Rozniecki, U.S. Pat. No. 3,915,237, discloses a ruptureable disc that is pierced by a cutting annulus that is moved by an explosive charge. At column 1, lines 45 to 50, Rozniecki discloses use of infrared and ultraviolet sensors to sense fire. Hardesty, U.S. Pat. No. 3,983,892, discloses an explosive valve having an electrical detonator that shears a diaphragm seal. Zehr, U.S. Pat. No. 4,006,780, discloses a rupturing head for fire extinguishers wherein a fusible link melts and causes a spring-loaded punch to rupture a sealing disk. Ball, U.S. Pat. No. 4,423,326, at column 2, lines 42 through 60, discloses using two radiation detectors, which may be thermopile sensors viewing radiation through appropriate filters, one being sensitive to radiation within a narrow wavelength band centered at 0.96 microns and the other being sensitive to radiation within a narrow wavelength band centered at 4.4 microns. Wittbrodt et al., U.S. Pat. No. 4,893,680, discloses sensors for a fire suppressant system and, at column 3, lines 27-30, discloses the use of solenoid and explosive-activated squib valves. Parsons et al., U.S. Pat. No. 5,059,953, describes a fire detection system that comprises an infrared detector and a rotating optical assembly. At column 7, line 20, use of a thermal switch is disclosed. At column 7, line 30, use of a filtered thermopile is disclosed that senses filtered infrared at a wavelength of 4.35 microns. Swanson, U.S. Pat. No. 5,299,592, discloses an electrically-operated valve having a spring-biased check valve with a solenoid-actuated pilot valve. Marts et al., U.S. Pat. No. 5,470,043, describes a Direct Current magnetic latching solenoid that retains a moving armature in a first or second position by a pair of magnets. At column 1, lines 19-55, it is disclosed that the solenoid is used to operate a series of irrigation control valves. Thomas, U.S. Pat. No. 5,918,681, discloses a fire extinguishing system for automotive vehicles in which an explosive squib propels a pin extending axially from a piston to puncture a sealed outlet of a cylinder, thereby releasing extinguishing material, and an alternate embodiment discloses using a solenoid to propel the piston and pin. Thomas, U.S. Pat. No. 6,164,383, has a similar disclosure to Thomas, U.S. Pat. No. 5,918,681, and additionally discloses control circuitry with sensors. Ahlers, U.S. Pat. No. 6,107,940, discloses a valve in which a pressure cartridge actuator is used to cause a pressure wave that ruptures a frangible disc to release fire suppressant material. Brown, et al., U.S. Pat. No. 6,184,980, discloses a silver halide fiber optic sensor for detection and identification of petroleum. James, U.S. Pat. No. 6,189,624, discloses a fire extinguisher in which a matchhead detonator, of the type used in pyrotechnic devices, is used to move a piston with a sharp spike so that the spike ruptures a diaphragm and causes release of fire suppressant material. Tapalian et al., U.S. Pat. No. 6,657,731, discloses a miniaturized high-resolution chemical sensor using a waveguide-coupled microcavity optical resonator for sensing a molecule species that has applicability in the fields of manufacturing process control, environmental monitoring, and chemical agent sensing on the battlefield. Grabow, U.S. Pat. No. 6,619,404, discloses a fire extinguisher piping system below deck in an aircraft, with discharge nozzles in the passenger and crew compartments. van de Berg, et al., U.S. Pat. No. 6,832,507, discloses a sensor for detecting the presence of moisture, and uses a transmitter-receiver for generating an electromagnetic interrogation field. Bordynuik, U.S. Pat. No. 7,115,872, discloses a well-known radiation detector for dirty bomb and lost radioactive source detection applications. The detector combines indirect radiation detection using a scintillator and photodiode and direct radiation detection by placing the photodiode and a high gain amplifier in the path of radiation, and generates an alarm that indicates the presence of radiation. McLane, Jr., U.S. Pat. No. 7,117,950, discloses a manual discharge fire suppression system in combination with either an electrically-operated explosive squib or an electrically-driven solenoid that moves a piston from a retracted position to a extended position, thereby causing a ram with a piercing member to pierce a seal and cause a fire suppressant to be released. Tice, U.S. Pat. No. 7,232,512, discloses a system and method for sensitivity adjustment for an electrochemical sensor to detect gasses including carbon monoxide, carbon dioxide, propane, methane, and potentially-explosive gases. Takayasu, et al., U.S. Pat. No. 7,242,789, discloses an image sensor that detects a moving body, and provides a movement direction and speed of a moving body that moves between two photodetector stations. BAE Systems PLC, WIPO Publication No. WO 03/072200 A1, describes a bolt and nut assembly with an integrated temperature sensor including a thermocouple, and an electronics module receives a signal from the sensor. At page 2, lines 7 through 10, this WIPO publication discloses that U.S. Pat. No. 4,423,326 discloses to use "two detectors . . . , each detector being sensitive to radiation in different wavelength bands, for example, narrow wavelength bands centered at 0.96 μm and 4.4 μm."

None of these references, either singly or in combination, disclose or suggest the present invention.

BRIEF SUMMARY OF THE INVENTION

The present invention is a hazard detection and suppression apparatus with self-fail monitoring and a plurality of sensors detecting different hazard conditions, and the apparatus preferably actuates a single-action discharge valve that can also be remotely manually actuated. Hazard detectors that may be used include an infrared sensor for detecting infrared energy within a certain spectrum, a temperature sensor, a petroleum detector, a chemical sensor, a moisture detector, a radiation detector, a gas detector, and a moving body detector. In the preferred embodiments of the valve, a solenoid reciprocates an armature, causing a frangible seal to become broken and to release the contents of a pressurized vessel through the valve. One or more pins or teeth are moved by the armature to break the frangible seal. An open, unblocked passage through the valve and its armature discharges the contents of the vessel when the seal becomes broken. Until actuation of the solenoid, the armature is preferably held in a first position by one or more magnets.

It is an object of the present invention to provide a hazard detection apparatus that senses a plurality of hazard conditions such as by early detection of a fire using infrared sensing within a certain spectrum over a field of view, ambient temperature sensing, and sensing of an overpressure condition within a pressurized vessel holding a suppressant. It is a further object of other embodiments of the invention to provide hazard sensing of petroleum, chemicals, moisture, radiation, gases, and a moving bodies. Preferably a single-action discharge valve is provided that can be remotely actuated to discharge the contents of the pressurized vessel holding the suppressant. It is a further object of the present invention that internal contents of the valve not be exposed prior to actuation to the pressurized material to be released. It is a further object of the invention that the valve, after discharge, be easily reconditionable for subsequent reuse.

BRIEF DESCRIPTION OF THE SEVERAL VIEWS OF THE DRAWING

FIG. 3 is sectional view of the armature of the first preferred embodiment of the valve of the present invention, taken along a diameter of the armature.

FIG. 4 is a side view of a pin of the first preferred embodiment of the valve of the present invention.

FIG. 5 is a side view of a pin of the third preferred embodiment of the valve of the present invention.

FIG. 6 is a top view of the third preferred embodiment of the valve of the present invention.

FIG. 7 is a side elevation view of the outlet cap of all preferred embodiments of the valve of the present invention.

FIG. 8 is a sectional view of the base mounting of the third preferred embodiment of the valve of the present invention.

FIG. 9 is a side elevation view of the bobbin of the third preferred embodiment of the valve of the present invention.

FIG. 10 is a top view of the bobbin of the third preferred embodiment of the valve of the present invention, taken substantially along the line 10-10 shown in FIG. 9.

FIG. 11 shows a top-level system diagram of the hazard detection and suppression apparatus of the present invention when used as a fire detection and extinguishing apparatus, symbolically showing sensors and actuating circuitry used with the valve of the present invention.

FIG. 19 is an underside plan view, looking upward, of a thermopile detector matrix of the present invention.

FIG. 20 is a first side sectional view of the thermopile detector matrix of the present invention, taken substantially along the line 20-20 shown in FIG. 19.

FIG. 21 is a second side sectional view of the thermopile detector matrix of the present invention, taken substantially along the line 21-21 shown in FIG. 19.

FIG. 22 is a front view of a fire extinguisher system of the present invention.

FIG. 23 is an end view of the fire extinguisher system of the present invention, taken substantially along the line 23-23 shown in FIG. 22.

FIG. 24 is a side elevation view of a vehicle with a plurality of the fire extinguisher systems of the present invention installed under a fender of the vehicle, with each fire extinguisher system monitoring and protecting a wheel and axle of the vehicle.

FIG. 34 is a schematic block diagram of the thermopile detector matrix electronics for use with the thermopile detector matrix of the present invention shown in FIGS. 19, 20, and 21.

FIG. 35 is a block diagram showing the present invention adapted with a petroleum detector, with a fire suppressant or petroleum containment and amelioration agent being dispensed by the discharge valve.

FIG. 36 is a block diagram showing the present invention adapted with a high-resolution chemical sensor, with a suppressant or antidote being dispensed by the discharge valve.

FIG. 37 is a block diagram showing the present invention adapted with a moisture detector, with a drying agent being dispensed by the discharge valve.

FIG. 38 is a block diagram showing the present invention adapted with a radiation detector, with a suppressant or antidote being dispensed by the discharge valve.

FIG. 39 is a block diagram showing the present invention adapted with a gas sensor, with a suppressant or antidote or neutralizing agent being dispensed by the discharge valve.

FIG. 40 is a block diagram showing the present invention adapted with a moving body sensor, with a non-hazardous chemical marking agent being dispensed by the discharge valve.

DETAILED DESCRIPTION OF THE INVENTION

Figure 1:
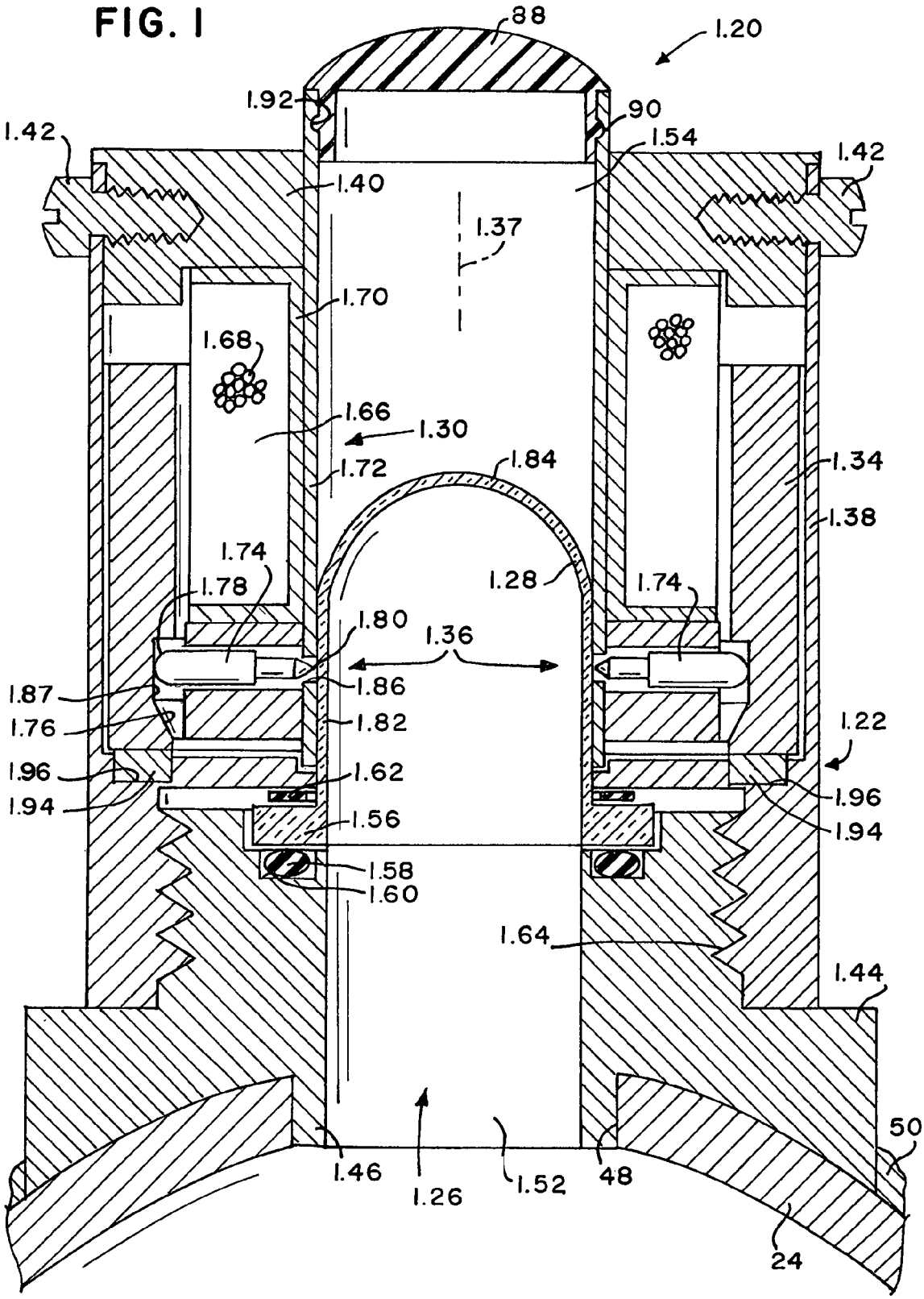
FIG. 1 is a sectional view of a first preferred embodiment of the valve of the present invention taken along a diameter thereof, showing the armature in a first position.

FIGS. 19-32, 33A, 33B, 33C, and 34-40 show various aspects of the hazard detection and suppression apparatus of the present invention, and FIGS. 1-18 show three preferred embodiments, 1.20, 2.20, and 3.20, of the single-action discharge valve of the present invention. It should be understood that other discharge valves, and even multiple-use discharge valves, may be used with the hazard detection and suppression apparatus of the present invention as appropriate for a given application, but the three preferred valve embodiments 1.20, 2.20, and 3.20 are believed best suited when the hazard is rare and is of such critical importance, such as in the case of extinguishing of a fire hazard, that rapid discharge of a suppressant leads to use of a single-action discharge valve with the apparatus. The structure and use of the three preferred embodiments 1.20, 2.20, and 3.20 of the single-action discharge valve will first be discussed in detail, followed by a description of the structure and use of the hazard detection and suppression apparatus itself. Identifying reference designators for all embodiments of the valve are marked similarly, with the reference designators for the three embodiments respectively having prefixes of "1.", "2.", and "3." and with similar structural features of the various embodiments having the same suffix (e.g., "1.20", "2.20", and "3.20"). It shall be understood that many aspects of the various preferred embodiments are substantially the same, and only the differences will be treated in detail, it being understood that similar structural features of the various embodiments perform similar functions.

All embodiments of the valve 1.20, 2.20, and 3.20 include a valve body, respectively 1.22, 2.22, and 3.22, for attaching to a pressurized vessel 24, and the valve body of all embodiments has a passage, respectively 1.26, 2.26, and 3.26, therethrough through which contents of the vessel are discharged when the valve is opened as hereinafter described. The contents of pressurized vessel 24 may be any pressurized material, such as a gas or liquid or mixture thereof, or a dry material or powder. When used for emergency release of fuel or other liquids, the valve, inverted from the views shown in the drawings, can be used to discharge from a port on a bottom region of a vessel such as, for example, a fuel tank, and the weight of the liquid in the vessel provides pressure to discharge through the valve. All embodiments of the invention are preferably substantially cylindrically symmetric for ease of manufacture and for improved performance, so that sectional views along a diameter of the valve will suffice to show the structure of the valve. However, there is no requirement that the valve be cylindrically symmetric, and other structures can be used without departing from the scope of the present invention. Furthermore, one of the advantages of all embodiments of the valve of the present invention is that it can be readily scaled to smaller or larger sizes in order to provide a larger discharge passage to accommodate any desired discharge flow rate.

All embodiments of the valve also include a frangible seal, respectively 1.28, 2.28, and 3.28 and hereinafter described in greater detail, held within the valve body and sealing the passage while the seal is intact. The frangible seal may be made from glass, polycarbonate or metal, but, in the preferred embodiments shown in the drawings, the frangible seal is made of glass, preferably well-known and inexpensive soda-lime glass. Construction of a frangible seal from metal is well-known, and is done by forming one or more grooves in the seal as by machining or, more often, by chemical etching. An undesirable characteristic of constructing the frangible seal of metal is that certain metals may react with contents of the vessel as by corrosion or contamination while the seal blocks those contents from release prior to actuation of the valve. For this reason, a frangible seal of glass or polycarbonate material is preferred. It shall be noted that, in all embodiments of the invention, all parts of the valve are blocked from the material held in the pressurized vessel by the frangible seal, and thus the valve's components are not exposed to possible corrosion or contamination by, or reaction with, the contents of the vessel prior to discharge.

All embodiments of the valve further include a solenoid, respectively 1.30, 2.30, and 3.30 and hereinafter described in greater detail, for selective connection to an electrical power source 32, such as a battery or other source of electrical power, for selective actuation of an armature, respectively 1.34, 2.34, and 3.34 and hereinafter described in greater detail, of the solenoid. The armature, as hereinafter described for the various preferred embodiments, moves from a first position to a second position and moves impacting means of each embodiment, respectively impacting means 1.36, 2.36, and 3.36, for breaking the frangible seal into at least two pieces, so as to cause the impacting means to break the seal as the armature moves into the second position. The fracturing or breaking of the frangible seal provides an improvement over prior art valves that simply pierce a seal without having the seal fracture or break into pieces and thus do not open up an enlarged passageway for rapid discharge of the contents of a pressurized vessel. In all embodiments, as hereinafter explained in greater detail, the passage, respectively 1.26, 2.26, and 3.26, preferably passes through the armature, with the armature being substantially exterior of the passage and preferably surrounding the passage. Additionally, in all embodiments, the passage preferably has a central axis of symmetry, respectively 1.37, 2.37, and 3.37, along which the armature reciprocates from the first position to the second position.

Referring specifically to FIGS. 1-4 and 7, the structure of the first preferred embodiment 1.20 of the valve of the present invention can now be explained in detail.

Valve body 1.22 of valve 1.20 includes a housing 1.38, a top cap plate 1.40 held within housing 1.38 as by a plurality of screws 1.42, and a base mounting 1.44. Base mounting 1.44 is made of aluminum and has a flange 1.46 that is inserted into a port 48 of vessel 24, and then base mounting 1.44 is welded about its perimeter to vessel 24 as by weld 50 to seal base mounting 1.44 to vessel 24. It shall be understood that valve 1.20 is preferably assembled and tested after welding base mounting 1.44 to vessel 24. It should be understood that all embodiments of the present invention may equivalently, without departing from the spirit and scope of the present invention, have a well-known threaded pipe (not shown) extending from the valve's inlet, respectively 1.52, 2.52, and 3.52, for screwing insertion into a mating threaded port of vessel 24 rather than by welding a base mounting to the vessel.

Valve body 1.22 has an inlet 1.52 and an outlet 1.54 and passage 1.26 through valve body 1.22 connects inlet 1.52 to outlet 1.54, allowing the contents of vessel 24 to discharge through the valve 1.20 when frangible seal 1.28 becomes broken.

Frangible seal 1.28 of valve 1.20 is generally dome-shaped or thimble-shaped, having a seal periphery portion or flange 1.56 at its base that is grippingly and sealingly entrapped within valve body 1.22 between housing 1.38 and base mounting 1.44. A well-known Nitrile O-ring 1.58 on the lower surface of flange 1.56 within circular groove 1.60 in base mounting 1.44 provides a tight seal that prevents leakage of the pressurized contents of vessel 24 while seal 1.28 is intact, and the gripping entrapment of seal 1.28 between housing 1.38 and base mounting 1.44 around flange 1.56 provides, by the high shear strength of seal 1.28 at flange 1.56, great strength for withstanding the pressure in vessel 24 without premature breakage of seal 1.28. Valve 1.20 has a well-known Nitrile washer 1.62 between the upper surface of flange 1.56 and valve housing 1.38 to cushion flange 1.56 of frangible seal 2.28 from breaking during assembly of valve housing 1.38 to base mounting 1.44 as those two parts are screwingly fitted together at threads 1.64.

Valve 1.20 includes a solenoid 1.30 comprising a coil 1.66 constructed of a length of wire 1.68 wound upon a hard-anodized aluminum bobbin 1.70 that encircles a cylindrical core 1.72. It shall be understood that bobbin 1.70 is fully wound with wire 1.68, and that only a portion of wire 1.68 is shown for illustrative purposes. It shall be further understood that bobbin 1.70 may be eliminated if coil 1.66 is wound on an external fixture and then potted with potting compound to maintain its shape, thereby permitting additional coil windings in the space that otherwise would be occupied by the bobbin and, if required by extreme environmental conditions, coil 1.66 may also be potted into place inside valve 1.20.

Figure 2:
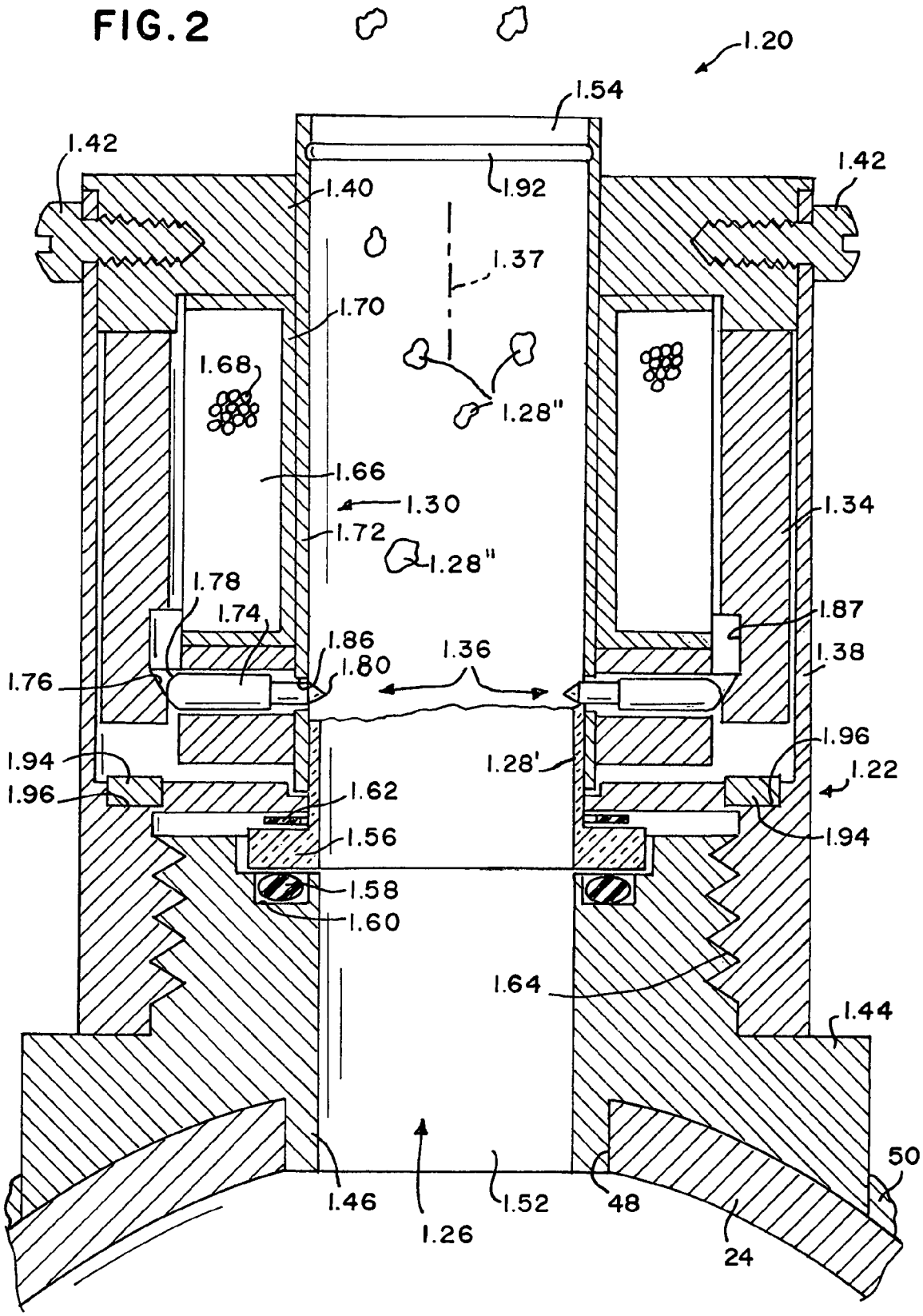
FIG. 2 is also a sectional view of the first preferred embodiment of the valve of the present invention taken along the same diameter as in FIG. 1, but showing the armature in a second position in which the reciprocated pins have broken the frangible seal.

Solenoid 1.30 further comprises an armature 1.34 that, when coil 1.66 is energized to create a magnetic field therewithin, reciprocates upwardly from a first position shown in FIG. 1 to a second position shown in FIG. 2. The armature of all embodiments as well as the core and the valve body and its housing of all embodiments are preferably constructed of so-called "electrical steel" or "transformer steel" such as SAE C1017 alloy material or equivalent, having low carbon content so as to provide satisfactory magnetic properties. If the armature and the parts of the valve body will be subjected to a corrosive environment, then those parts preferably will be provided with a corrosive-preventative coating so as to prevent corrosion. Alternatively, stainless steel with magnetic properties could be used, or the surface of these parts could be plated with a material such as nickel to prevent corrosion.

Conventional prior art solenoid construction is designed for rapid operation of the solenoid, which calls for an armature of very low mass. In contrast with these teachings, the armatures of the present invention must have significant mass so as to develop sufficient kinetic energy to break the frangible seal. As a rule of thumb, the mass of the armature respectively 1.34, 2.34, and 3.34, should preferably be at least one-half of the mass of the valve body, respectively 1.22, 2.22, and 3.22, so that most of the magnetic energy goes into movement of the armature, thereby developing sufficient force to break the frangible seal. Because the armature, when the solenoid is engaged, reciprocates toward the center of the solenoid, the valve is constructed so that the armature begins its reciprocation from the first position well off-center of the solenoid, and so that the second position, when the impacting means strikes and breaks the frangible seal, occurs before the armature's reciprocation reaches the center of the solenoid. It has been found that the force required to fracture a frangible seal disk is related to the material and the thickness of the frangible seal disk. An armature is chosen to provide a magnetic density and physical size that allows a pre-travel sufficient to reach maximum speed prior to impacting the frangible seal. The electrical power input to the coil is tailored to force the coil to reach maximum magnetic force 2.5 to 3.0 milliseconds after application of a suitable electrical signal to the coil. The electrical voltage and current supplied to the coil, the physical size and mass of the armature, the number of pins or teeth of the impacting means (hereinafter described), and disc size and material are adjusted as required for a given valve size to yield repeatable fracture of the frangible seal of the valve. An advantage of the first embodiment 1.20 over the second and third embodiments 2.20 and 3.20 is that, in the first embodiment 1.20, the armature 1.34, being exterior to the coil 1.66 and thus larger than the armatures of the other embodiments, may have greater mass than armatures 2.34, 3.34.

It shall be understood that frangible seals 1.28, 2.28, and 3.28 must be designed to have a strength sufficient to contain the pressure in vessel 24 and still be able to be broken by the impacting means of each embodiment, as hereinafter described. For a given seal, its strength is determined by the material used, the thickness of the material, the manner in which the seal is gripped, and the presence or absence of surface imperfections on the seal. If a stronger seal is desired, surface imperfections can be removed as by polishing or heat treating. If a weaker seal is desired, surface imperfections may be added as by, for example, etching. In the preferred embodiments of the present invention, it has not been found necessary to add or remove surface imperfections.

Valve 1.20 further includes impacting means 1.36 for breaking frangible seal 1.28 into at least two pieces, with impacting means 1.36 being moved by armature 1.34 to break frangible seal 1.28 as armature 1.34 moves into the second position. In the first embodiment 1.20 of the present invention, impacting means 1.36 includes at least one pin 1.74 mounted for reciprocation within valve body 1.22 in a plane radial with respect to armature 1.34, with the reciprocation plane also including the axis of symmetry of armature 1.34 therewithin and with pin 1.74 preferably being mounted for reciprocation perpendicular to sidewall 1.82 of domed portion 1.84 of frangible seal 1.28. Armature 1.34 has a cam portion 1.76 that engages the rear end 1.78 of pin 1.74 as armature 1.34 moves from the first position shown in FIG. 1 to the second position shown in FIG. 2, thereby causing the pointed tip 1.80 of pin 1.74 to forcibly impact the sidewall 1.82 of domed portion 1.84 of frangible seal 1.28 and thus break the seal 1.28 into at least two pieces, namely, the remainder 1.28' of the seal shown in FIG. 2 with flange 1.56 being held between base mounting 1.44 and housing 1.38, and at least one other seal fragment 1.28" that is discharged through passage 1.26 by the pressure in vessel 24. Preferably valve 1.20 includes a plurality of pins 1.74 angularly spaced about the axis of armature 1.34 so as to jointly impact seal 1.28 at multiple impact points about sidewall 1.82, thereby providing symmetric forces upon armature 1.34 so as not to cause armature 1.34 to bind as it reciprocates and cams pins 1.74. Each pin 1.74 is preferably constructed of case-hardened steel of hardness Rockwell C30 so as to prevent blunting of the tip 1.80 during impact with seal 1.28, and extends through a respective hole 1.86. It should be noted that armature 1.34 has a pre-camming portion 1.87 so that armature 1.34 has a pre-travel portion of reciprocation during which it can build up sufficient kinetic energy prior to engagement of rear portion 1.78 of pins 1.74 by cam portion 1.76 of armature 1.34.

As with all embodiments, valve 1.20 may optionally have a discharge cap 88, preferably made of a durable material such as nylon, inserted into its outlet 1.54, and an encircling flange 90 of cap 88 engages with a mating groove 1.92 within outlet 1.54, so as to retain cap 88 within outlet 1.54 until valve 1.20 is actuated. The purpose of cap 88 is to prevent debris such as mud, etc., from clogging the valve prior to actuation of the valve. When the valve discharges the contents of vessel 24, the pressure of the escaping material easily blows cap 88 off of outlet 1.54.

In order to hold the armature in the first position prior to actuation of the solenoid, one or more magnets 1.94 are mounted in the valve body as in holes 1.96 for magnetically latching armature 1.34 in the first position, and the magnets must be selected to be of sufficient strength so that armature 1.34 does not become released from the first position prior to actuation of the solenoid due to mechanical shocks that the valve might receive, because premature release of the armature prior to actuation of the solenoid could cause unwanted breakage of the frangible seal. This latching also causes the armature to be held in its first position while the coil is developing its full magnetic energy after actuation of the solenoid so that a maximum kinetic energy can be imparted to the armature by the coil, thereby creating a greater impact force to break the frangible seal. If a spring were to be used to keep the armature in the first position, it would oppose the armature during its travel toward the second position and thereby reduce the kinetic energy of the armature for breaking the frangible seal. If a glue were to be used to hold the armature in the first position, such that the solenoid would have to overcome the binding power of the glue in order to release the armature from the first position, such a glue could deteriorate due to temperature and moisture and thus weaken over time, causing premature release of the armature from the first position. The magnets 1.94, which are preferably used in all embodiments of the present invention, are preferably cylindrical and are, for example, 0.125 inches (0.318 cm.) in diameter and 0.625 inches (0.159 cm.) thick, and are glued into holes 1.96. It shall be understood that larger or smaller magnets, and a greater or lesser number of magnets, can be used as the valve is scaled to larger or smaller sizes, without departing from the spirit and scope of the present invention.

Turning now to FIGS. 12, 13, 15, and 16, the second preferred embodiment 2.20 of the valve of the present invention can now be described.

Valve body 2.22 of valve 2.20 includes a housing 2.38, a top cap plate 2.40 held within housing 2.38 as by a plurality of screws 2.42, and a base mounting 2.44. Base mounting 2.44 is made of aluminum and is welded about its perimeter to vessel 24 as by weld 50 to seal base mounting 2.44 to vessel 24, and it shall be understood that, as with the first embodiment 1.20 of the valve shown in FIGS. 1 and 2, base mounting 2.44 may also have a flange for inserting into port 48 of vessel 24. It shall be further understood that valve 2.20 is preferably assembled and tested after welding base mounting 2.44 to vessel 24.

Valve body 2.22 has an inlet 2.52 and an outlet 2.54 and passage 2.26 through valve body 2.22 connects inlet 2.52 to outlet 2.54, allowing the contents of vessel 24 to discharge through the valve 2.20 when frangible seal 2.28 becomes broken.

The frangible seals 2.28 and 3.28 of the second and third embodiments are substantially similar, and a description of seal 2.28 and its mounting will suffice for both.

Seal 2.28 is preferably a disk of soda-lime glass gripped around its perimeter at a seal periphery portion 2.56 by entrapment within valve body 2.22 between housing 2.38 and base mounting 2.44, and a well-known Nitrile O-ring 2.58 within circular groove 2.60 in base mounting 2.44, forms a seal between base mounting 2.44 and frangible seal 2.28. Valve 2.20 has a well-known Nitrile washer 2.62 between the upper surface of seal 2.28 and valve housing 2.38 to cushion frangible seal 2.28 from breaking during assembly of valve housing 2.38 to base mounting 2.44 as those two parts are screwingly fitted together at threads 2.64. It has been found that this washer 2.62 on the upper surface of the frangible seal may be eliminated, as shown for valve 3.20, by a more precise flatness specification/tolerance on the underside surface of the valve body (underside surface of valve housing 2.38 of valve 2.20, or underside surface of base plate 3.102 of valve 3.20) that contacts the frangible seal. Seal 2.28 also provides a fail-safe mechanism whereby seal 2.28 will fracture and break if the pressure within vessel 24 becomes excessive, thereby preventing explosion of vessel 24.

Valve 2.20 includes a solenoid 2.30 comprising a coil 2.66 constructed of a length of wire 2.68 wound upon a hard-anodized aluminum bobbin 2.70 that encircles a cylindrical core 2.72. It shall be understood that bobbin 2.70 is fully wound with wire 2.68, and that only a portion of wire 2.68 is shown for illustrative purposes. It shall be further understood that bobbin 2.70 may be eliminated if coil 2.66 is wound on an external fixture and then potted with potting compound to maintain its shape, thereby permitting additional coil windings in the space that otherwise would be occupied by the bobbin and, if required by extreme environmental conditions, coil 2.66 may also be potted into place inside valve 2.20.

Figure 12:
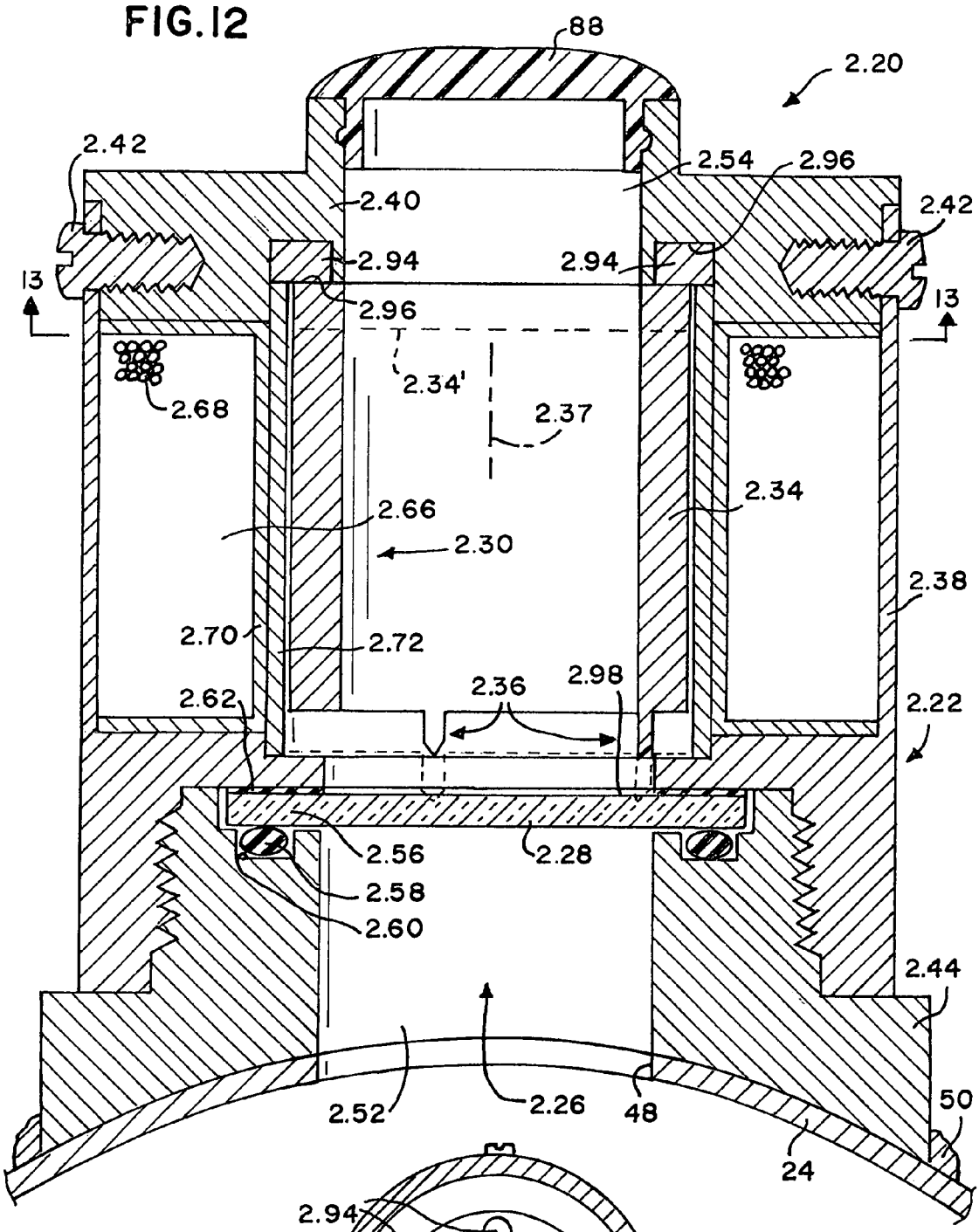
FIG. 12 is a sectional view of a second preferred embodiment of the valve of the present invention taken along a diameter thereof, showing the armature in a first position and, in dotted outline, showing the armature as it moves into a second position in which the teeth impact the frangible seal.
Figure 13:
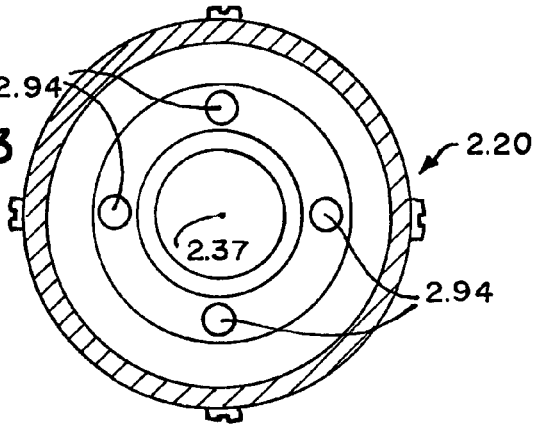
FIG. 13 is an upward-looking transverse view of the second preferred embodiment of the valve of the present invention, taken substantially along the line 13-13 shown in FIG. 12, showing the mounting of the magnets.

Solenoid 2.30 further comprises an armature 2.34 that, when coil 2.66 is energized to create a magnetic field therewithin, reciprocates downwardly from a first position shown in FIG. 12 to a second position 2.34' shown in dotted outline in FIG. 12.

Valve 2.20 further includes impacting means 2.36 for breaking frangible seal 2.28 into at least two pieces, with impacting means 2.36 being moved by armature 2.34 to break frangible seal 2.28 as armature 2.34 moves into the second position. In the second embodiment 2.20 of the present invention, impacting means 2.36 comprises at least one tooth 2.100 depending from armature 2.34 toward seal 2.28. Preferably valve 2.20 includes a plurality of teeth 2.100 angularly spaced about the axis of armature 2.34 so as to jointly impact seal 2.28 at multiple impact points adjacent periphery portion 2.56 of seal 2.28, thereby providing symmetric forces upon armature 2.34 so as not to cause armature 2.34 to bind as it reciprocates and causes teeth 2.100 to impact seal 2.28. It has been found that teeth 2.100 become blunted upon impact with seal 2.28, and an improvement of the third embodiment 3.20, hereinafter described, providing pins 3.74 separate from the armature, allows the pins to be formed of harder material than the magnetic material used for construction of the armature, thereby permitting reuse of pins 3.74 or replacement of the pins separate from the armature.

As with valve 1.20, valve 2.20 may optionally have a discharge cap 88 as heretofore described.

In order to hold the armature in the first position prior to actuation of the solenoid, one or more magnets 2.94 are mounted in the valve body as by gluing within holes 2.96 for magnetically latching armature 2.34 in the first position, and the magnets must be selected to be of sufficient strength so that armature 2.34 does not become released from the first position prior to actuation of the solenoid due to mechanical shocks that the valve might receive, because premature release of the armature prior to actuation of the solenoid could cause unwanted breakage of the frangible seal. As with the first embodiment, this latching also causes the armature to be held in its first position, while the coil is developing its full magnetic energy after actuation of the solenoid, so that a maximum kinetic energy can be imparted to the armature by the coil, thereby creating a greater impact force to break the frangible seal.

Turning now to FIGS. 5, 6, 8, 9, 10, 14, 17, and 18, the third preferred embodiment 3.20 of the valve of the present invention can now be described.

Valve body 3.22 of valve 3.20 includes a housing 3.38, a base plate 3.102 held within housing 3.38 as by a plurality of screws 3.42, a seal pressure plate 3.104 for holding frangible seal 3.56 within valve body 3.22, and a base mounting 3.44 that is made of aluminum. In a variation from the first and second embodiments, base mounting 3.44 may be separated from the valve body 3.22 and can be welded about its perimeter to vessel 24 as by weld 50 to seal base mounting 3.44 to vessel 24 while flange 3.46 is received into port 48 of vessel 24. This structure of valve 3.20 allows the valve 3.20 to be assembled and pressure tested independent of base mounting 3.44, and prevents damage to valve 3.20 as base mounting is welded to vessel 24. In a modified structure of the seal mounting of valve 2.20, a seal pressure plate 3.104 is screwingly received into threads 3.64 of base plate 3.102, as by inserting a pronged tool or wrench into blind holes 3.106 of seal pressure plate 3.104 during assembly. It shall be understood that the structure of base plate 3.102, seal pressure plate 3.104, and base mounting 3.44 could be used with embodiments 1.20 and 2.20 without departing from the spirit and scope of the present invention. A hex nut fitting 3.107, best seen in FIG. 6, is preferably provided at the top of housing 3.38 to permit tightening of valve 3.20 onto base mounting 3.44 after base mounting 3.44 has been welded to vessel 24.

Valve body 3.22 has an inlet 3.52 and an outlet 3.54 and passage 3.26 through valve body 3.22 connects inlet 3.52 to outlet 3.54, allowing the contents of vessel 24 to discharge through the valve 3.20 when frangible seal 3.28 becomes broken.

The frangible seals 3.28 and 3.28 of the second and third embodiments are substantially similar, and the previous description of seal 2.28 suffices for both.

Frangible seal 3.28 is preferably a disk of soda-lime glass gripped around its perimeter at a seal periphery portion 3.56 by entrapment within valve body 3.22 between base plate 3.102 and seal pressure plate 3.104, and a well-known Nitrile O-ring 3.58 within circular groove 3.60 in seal pressure plate 3.104 forms a seal between seal pressure plate 3.104 and frangible seal 3.28. It should be noted that valve 3.20 does not require a washer between the upper surface of seal 3.28 and base plate 3.102 to prevent seal 3.28 from breaking during assembly of seal pressure plate 3.104 into base plate 3.102 as those two parts are screwingly fitted together at threads 3.64. It has been found that this washer on the upper surface of the frangible seal could be eliminated by a more precise flatness specification/tolerance on the underside surface of base plate 3.102 that contacts frangible seal 3.28. As heretofore described for seal 2.28, seal 3.28 also provides a fail-safe mechanism whereby seal 3.28 will fracture and break if the pressure within vessel 24 becomes excessive, thereby preventing explosion of vessel 24.

Valve 3.20 includes a solenoid 3.30 comprising a coil 3.66 constructed of a length of wire 3.68 wound upon a hard-anodized aluminum bobbin 3.70. It shall be understood that bobbin 3.70 is fully wound with wire 3.68, and that only a portion of wire 3.68 is shown for illustrative purposes. Bobbin 3.70 of valve 3.20 also serves as the core of this valve, rather than having a separate core as is the case in other embodiments.

Figure 14:
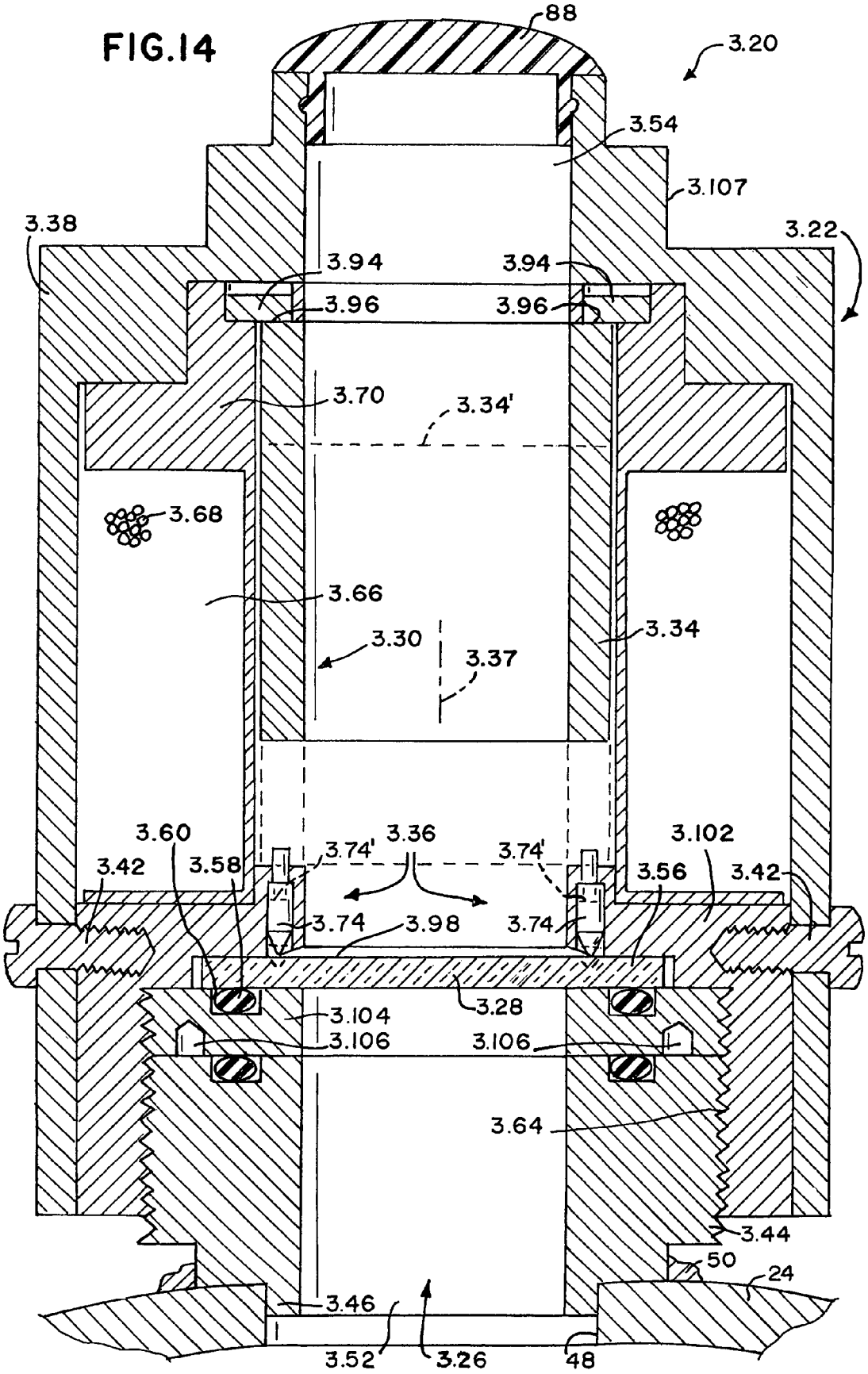
FIG. 14 is a sectional view of a third preferred embodiment of the valve of the present invention taken along a diameter thereof, showing the armature in a first position and, in dotted outline, showing the armature as it moves into a second position in which the reciprocating pins impact the frangible seal.
Figure 15:
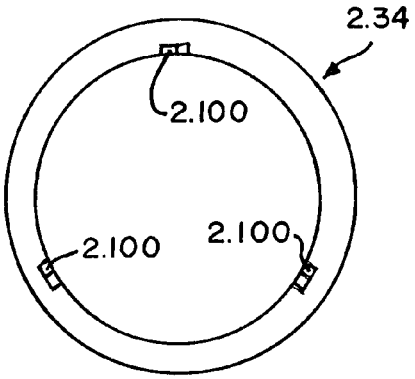
FIG. 15 is a bottom view of the armature of the second preferred embodiment of the valve of the present invention, taken substantially along the line 15-15 shown in FIG. 16.
Figure 16:
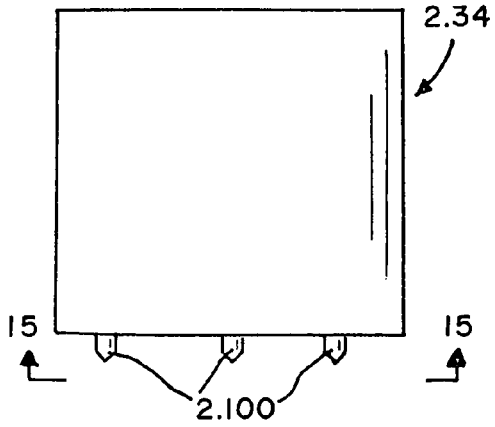
FIG. 16 side elevation view of the armature of the second preferred embodiment of the valve of the present invention.

Solenoid 3.30 further comprises an armature 3.34 that, when coil 3.66 is energized to create a magnetic field therewithin, reciprocates downwardly from a first position shown in FIG. 14 to a second position shown in dotted outline as 3.34' in FIG. 14.

Valve 3.20 further includes impacting means 3.36 for breaking frangible seal 3.28 into at least two pieces, with impacting means 3.36 being moved by armature 3.34 to break frangible seal 3.28 as armature 3.34 moves into the second position. In the third embodiment 3.20 of the present invention, impacting means 3.36 comprises a pin 3.74 mounted for vertical reciprocation within valve body 3.22 preferably substantially parallel to the mutual axis 3.37 of passage 3.26 and armature 3.34. Preferably valve 3.20 includes a plurality of pins 3.74 angularly spaced about the axis of armature 3.34 and mounted within bores 3.112 through base plate 3.102 so as to jointly impact seal 3.28 at multiple impact points adjacent periphery portion 3.56 of seal 3.28, thereby providing symmetric forces upon armature 3.34 so as not to cause armature 3.34 to bind as it reciprocates and causes pins 3.74 to impact seal 3.28 as they move to a position shown in dotted outline as 3.74'. As an improvement of the third embodiment 3.20 over the second embodiment 2.20, pins 3.74 are provided separate from the armature, thereby allowing the pins to be formed of harder material than the magnetic material used for construction of the armature, thereby permitting reuse of pins 3.74 or replacement of the pins separate from the armature.

Figure 17:
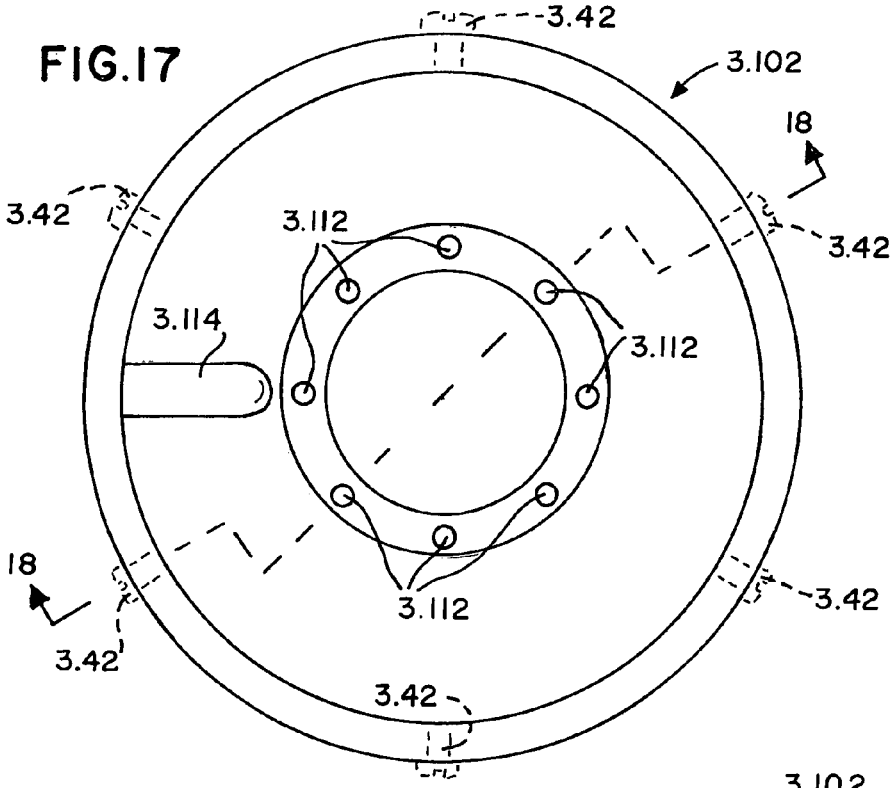
FIG. 17 is a top view of the base plate of the third preferred embodiment of the valve of the present invention, with the position of the casing screws shown in dotted outline for purposes of illustration.
Figure 18:
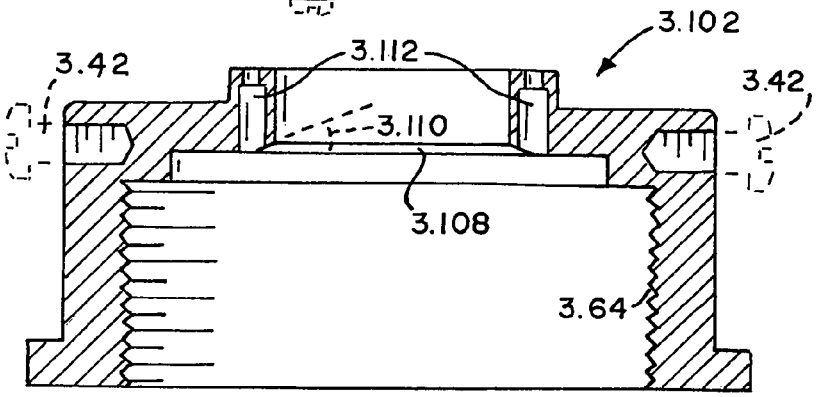
FIG. 18 is a sectional view of the base plate of the third preferred embodiment of the valve of the present invention, taken substantially along the line 18-18 shown in FIG. 17, with the position of the casing screws shown in dotted outline for purposes of illustration.

As best seen in FIG. 18, base plate 3.102 has a beveled surface 3.108, at an angle 3.110 of approximately 22 degrees, inwardly adjacent bores 3.112 for pins 3.74, thereby allowing for better discharge of frangible seal 3.28 when it becomes broken. As best seen in FIG. 17, a channel 3.114 is preferably provided within base plate 3.102 for wires 3.68 to pass from core 3.66 to the exterior of valve body 3.22.

As with valves 1.20 and 2.20, valve 3.20 may optionally have a discharge cap 88 as heretofore described.

In order to hold the armature in the first position prior to actuation of the solenoid, one or more magnets 3.94 are mounted in the bobbin 3.70 as by gluing within holes 3.96 for magnetically latching armature 3.34 in the first position, and the magnets must be selected to be of sufficient strength so that armature 3.34 does not become released from the first position prior to actuation of the solenoid due to mechanical shocks that the valve might receive, because premature release of the armature prior to actuation of the solenoid could cause unwanted breakage of the frangible seal. As with the first and second embodiments, this latching also causes the armature to be held in its first position while the coil is developing its full magnetic energy after actuation of the solenoid so that a maximum kinetic energy can be imparted to the armature by the coil, thereby creating a greater impact force to break the frangible seal.

FIG. 11 shows a top-level system diagram of the hazard detection and suppression apparatus of the present invention when used as a fire detection and extinguishing apparatus, symbolically showing sensors and actuating circuitry used with the preferred valve of the present invention. Referring to FIG. 11, to use all embodiments of the preferred valve of the present invention as a part of a fire extinguishing apparatus, the valve, generically represented as valve 20 in FIG. 11, is assembled as heretofore described, tested, and mounted to a vessel 24. Wires, generically represented as 68 in FIG. 11, are connected to control circuitry means 116 interposed between a well-known electrical power source 32 valve 20 for selective connection of the power source 32 to valve 20. A plurality of inputs 118, 120, 122, are operably connected to control circuitry 116, which is responsive to the inputs and, in response thereto, applies electrical power to valve 20. Infrared sensors 118, which trigger when optical energy is detected in the near-infrared region between about 0.2 microns to 10 microns, inclusive, and preferably in the range between about 2 to 10 microns, inclusive, are provided for early-warning detection of flames or heat sources 124 and for triggering of control circuitry 116. Temperature sensors 120, well-known in the prior art, are provided to trigger control circuitry 116 when the sensed temperature reaches a certain predetermined set temperature. One or more pushbuttons 122 are provided for manual actuation of valve 20. And, as heretofore described, an overpressure condition within vessel 24 will cause fail-safe breakage of the frangible seal of valve 20. When used as a fire extinguishing apparatus, there are thus multiple ways that valve 20 can be actuated. The first and most sensitive threshold of activation is when one of infrared optical sensors 118 detects sufficient optical energy in the near-infrared range heretofore described. When the temperature sensed by one of the temperature sensors 120 detects an over-temperature condition, the valve will also be triggered. As a third way of activation, if the pressure within vessel 24 builds to the point of an overpressure condition exceeding the strength of the frangible seal, the seal will fracture because of the overpressure condition, thereby safely releasing the pressurized contents of vessel 24.

After use, the valve can then be refurbished and re-used. The tips of pins 1.74, 3.74 or teeth 2.100 may be inspected and, if necessary, pins 1.74, 3.74 could be replaced from a refurbishment kit. Likewise, if teeth 2.100 are blunted, then armature 2.34 with teeth 2.100 could be replaced as a unit. Alternatively, a maintenance history of the valve may be kept, with these parts being replaced after a certain number of actuations. In critical reliability situations, pins 1.74, 3.74, or armature 2.34 with teeth 2.100, could be replaced on every refurbishment. All seals and O-rings typically will be replaced with new seals and new O-rings at each refurbishment to ensure reliable performance and operation.

To aid in filling the pressurized vessel 24, typically a filling port, such as a 1.25 inch (3.18 cm.) diameter port, is provided on one end of the vessel, and a plug containing a well-known Schrader valve is threadedly inserted into the port to seal the port. To fill the vessel 24 with fire suppressant, the plug is removed and a combination of off-the-self suppressant ingredients are added into the vessel. The plug is then re-inserted into the vessel's port to seal the vessel and inert gases are introduced into the vessel via the Schrader valve. After a multi-hour curing period, the ingredients form a gel that has a multi-year shelf life. The resultant fire suppressant becomes a dry powder when dispensed and is effective for Class A, B, and C fires.

When a relatively large area is to be monitored for a fire hazard, it is important to realize that a fire, when it initially starts, is often very localized, and it is important to detect the "hot spot" while the fire is relatively small so that the damage can be contained and so that the fire can be easily extinguished. If a fire gets out of control, great damage can occur and the fire will be difficult to extinguish.

A prior art approach to monitoring a large area for heat and fire is disclosed in Parsons et al., U.S. Pat. No. 5,059,953, which describes a fire detection system that comprises an infrared detector and a rotating optical assembly that causes the field of view to sweep a large area. A preferred embodiment of hazard monitoring for heat and fire over a large area is the thermopile detector matrix 200 shown in FIGS. 19, 20, 21, and 34, which is one preferred way that the present invention may implement one or both of the optical sensors 118 shown in FIG. 11.

It is known to have a lens in front of a thermopile detector to focus a field of view onto the sensitive area of the thermopile detector. However, if the field of view is too large, sensitivity of the thermopile detector will be lessened because the thermopile detector will average the infrared energy of the entire field of view. Consider, for example, a thermopile detector having a 3 foot by 3 foot (91 cm. by 91 cm.—an area of 1296 square inches or 8361 square cm.) field of view focused onto the thermopile detector's sensitive area. If the average temperature of the field of view is 100 degrees Fahrenheit with a hot spot of interest within that area being a 3 inch by 3 inch (7.6 cm. by 7.6 cm.—an area of 9 square inches or 58 square cm.) spot of 1000 degrees Fahrenheit, the average temperature seen by the thermopile detector will be about 107 degrees, as shown by the following calculation:

$$Temp_{AVG} = 100 + 1000 * \frac{9}{1296} = 106.9$$

A seven-degree rise in temperature over the average as seen by the thermopile detector would hardly be cause for alarm. On the other hand, if the thermopile detector only had a 1 foot by 1 foot (30.5 cm by 30.5 cm—an area of 144 square inches or 929 square cm.) field of view, again with an average temperature of 100 degrees Fahrenheit, with a 3 inch by 3 inch (7.6 cm. by 7.6 cm.—an area of 9 square inches or 58 square cm.) hot spot of 1000 degrees Fahrenheit, the average temperature seen by the thermopile detector will be about 162.5 degrees, as shown by the following calculation:

$$Temp_{AVG} = 100 + 1000 * \frac{9}{144} = 162.5$$

This would be cause for alarm and would provide an early detection of the fire.

To provide this increased sensitivity offered by a small field of view, matrix 200 has a plurality of spaced apart angled bores 202 formed within an aluminum base 204. Each of the bores is substantially identical except for its orientation, and, as shown in FIGS. 19-21, into each bore 202, shown by example in only one of the bores for exemplary purposes only, is received a thermopile detector T such as an ST-60 series thermopile detector in a TO-5 can made by Dexter Research Center, Inc., 7300 Huron River Drive, Dexter, Mich. 48130, to which a custom infrared bandpass filter is fitted that has a passband for optical energy in the near-infrared region between about 0.2 microns to 10 microns, inclusive, and preferably in the range between about 2 to 10 microns, inclusive. Each thermopile detector T is substantially identical, and a description of one will suffice for all.

Figure 27:
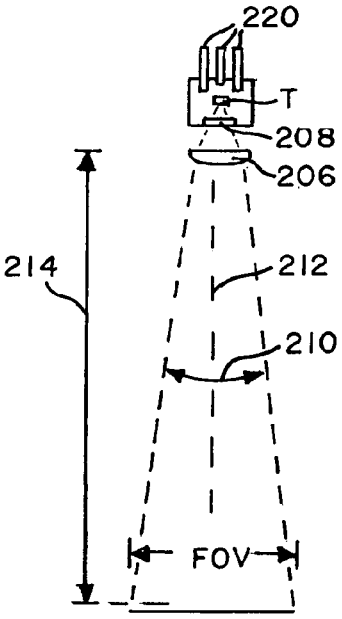
FIG. 27 is a diagram showing the field of view of a single thermopile detector used by the present invention.

Referring to FIG. 27, each thermopile detector T has a lens 206 in front of infrared passband filter 208, and lens 206 projects about a 14 degree angle of view 210 onto the thermopile detector's sensitive area, yielding a substantially axially-symmetric individual field of view "FOV" about a viewing axis 212 such that, at a distance 214 of about 8 feet (244 cm.), a matrix of 36 thermopile sensors can protect an area having a composite field of view of about 8 feet by 10 feet (244 cm. by 305 cm.) that consists of the respective fields of view of the plurality of thermopile detectors T.

Referring again to FIGS. 19-21, the respective viewing axes 212 of the respective thermopile detectors T are not mutually parallel, but instead are at different angles in both the length and width dimension of base 204, with the angles of successive axes 212 in FIG. 20, in sequence top to bottom of FIG. 20 with reference to a perpendicular line 216, preferably being 26.4 degrees, 16.6 degrees, 5.7 degrees, −5.7 degrees, −16.6 degrees, and −26.4 degrees. The angles of the viewing axes for other sections through all columns of matrix 200 (i.e., substantially parallel to line 20-20) are substantially as shown in FIG. 20. Likewise, the angles of successive axes 212 in FIG. 21, in sequence left to right of FIG. 21 with reference to a perpendicular line 218, are preferably −21.5 degrees, −13.3 degrees, −4.5 degrees, 4.5 degrees, 13.3 degrees, and 21.5 degrees. The angles of the viewing axes for other sections through all rows of matrix 200 (i.e., substantially parallel to line 21-21) are substantially as shown in FIG. 21. It should be understood that matrix 200 does not require that the thermopile detectors T be aligned in rows and columns as shown in FIG. 19, but only that the plurality of thermopile detectors preferably be spaced apart from each other with respective viewing axes that are not mutually parallel, such that the composite field of view consists of the respective individual fields of view of the plurality of thermopile detectors. As also seen in FIGS. 27 and 34, each thermopile detector T has a plurality of electrical leads 220 for supplying an output signal 222 having a voltage indicative of the infrared energy within the field of view FOV of thermopile detector T.

Figure 29:
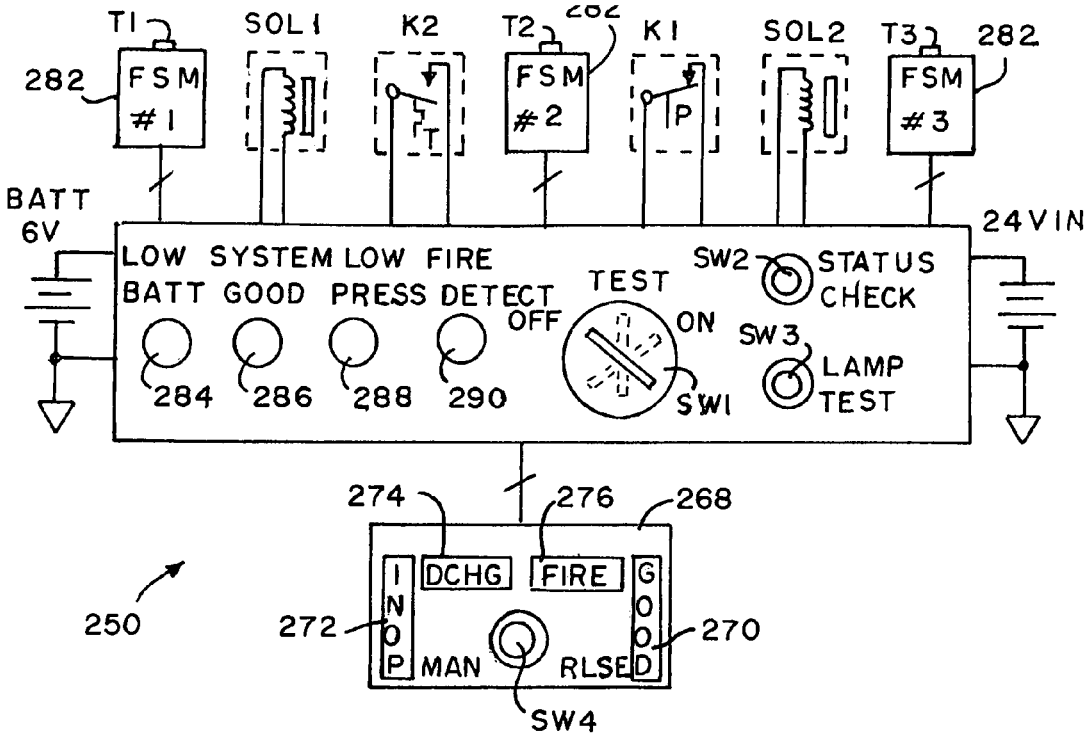
FIG. 29 is a block diagram of the fire extinguisher system of the present invention showing interconnection with a first embodiment of the crew panel.

Additionally, as in FIG. 11, matrix 200 may also include a temperature sensor such as a thermostat switch 120 mounted to base 204 in a recessed bore 224. Thermostat switch 120 is preferably a 5004 Series thermostat switch operated by a bimetal disc with positive reinforce snap-action, manufactured by Airpax, 550 Highland St., Frederick, Md. 21701, and is selected to actuate when the ambient temperature rises above 300 degrees Fahrenheit (149 degrees Celsius). This thermostat switch is used in the same manner as, and operates similarly to, thermostat switch K2 as shown in FIG. 29.

Referring now to FIG. 34, the thermopile detector matrix electronics can now be explained using this understanding of the thermopile detector matrix 200. The output signals 222 of the thermopile detectors T are fed into sampling means 226 for providing a sequence of output samples. Sampling means 226 preferably comprises an array of well-known analog switches 228 that are actuated in sequence to sequentially connect each of the thermopile detector output signals 222 to a node 230 and thus provide a sequence of output samples on node 230. Matrix 200 also preferably comprises peak-and-hold detector means 232 for preserving a maximum value 234 from the sequence of output signals over a period of time, such that, if one thermopile sensor T detects a "hot spot", its output voltage will rise and the peak-and-hold detector 232, having a slow decay time, will preserve this peak output for multiple scans of the thermopile detectors by sampling means 226. This preserved maximum value 234 is then passed through well-known amplitude comparator means 236 for comparing the preserved maximum value against a predetermined threshold to produce a binary output bit 238 indicative of whether the maximum value is indicative of an over-temperature condition. This preserved maximum value 234 is also passed through well-known analog-to-digital converter means 240 that converts the preserved maximum value 234 into a digital value 242 that is proportional to the preserved maximum value 234. If used to monitor a field-of-view area in an aircraft, a well-known ARINC 429 transmitter may be used to transmit this maximum value 234 and over-temperature indicator 238 to a system "fire warning display" (not shown) in a 32-bit data word over an industry-standard ARINC 429 bus as is commonly used in avionics applications. It shall be understood that the hazard detection and suppression apparatus of the present invention, as hereinafter described, may use matrix 200 to monitor a large field-of-view area instead of using individual thermopile detectors to monitor small fields-of-view.

In some applications, where small field-of-view targets are to be monitored for a hazard such as to monitor fires in a wheel well of a vehicle or warfare damage to an axle of a multi-axle vehicle, it is more appropriate to have individual thermopile detectors each monitoring a specific field-of-view. FIGS. 22, 23, 25, and 26 show a self-contained preferred embodiment 250 of the hazard detection and suppression apparatus of FIG. 11 as used to detect and suppress a fire. An enclosure 252 houses a status and reporting module and a plurality of sensor modules of apparatus 250, all hereinafter described in detail, and is mounted to a tank 24 filled with suppressant material under pressure. A pair of valves 20, preferably single-action discharge valves of the type hereinbefore described, are provided for releasing suppressant from tank 20 when directed by apparatus 250. A plurality of thermopile detectors T1, T2, and T3 are also provided for monitoring a field of view.

Thermopile detectors T1, T2, and T3 of apparatus 250 are preferably the same as each of the thermopile detectors T described hereinabove in connection with thermopile detector matrix 200, except that, with reference to FIGS. 25 and 26, the lens is chosen to have an angle of view of about 20 degrees so that a first field of view 254 of about 14.1 inches (36 cm.) in diameter is presented at a first field-of-view distance 256 of 40 inches (102 cm.), and so that so that a second field of view 258 of about 12.7 inches (32.3 cm.) in diameter is presented at a closer second field-of-view distance 260 of 36 inches (91.4 cm.), and the description hereinabove otherwise suffices for thermopile detectors T1, T2, and T3.

Figure 25:
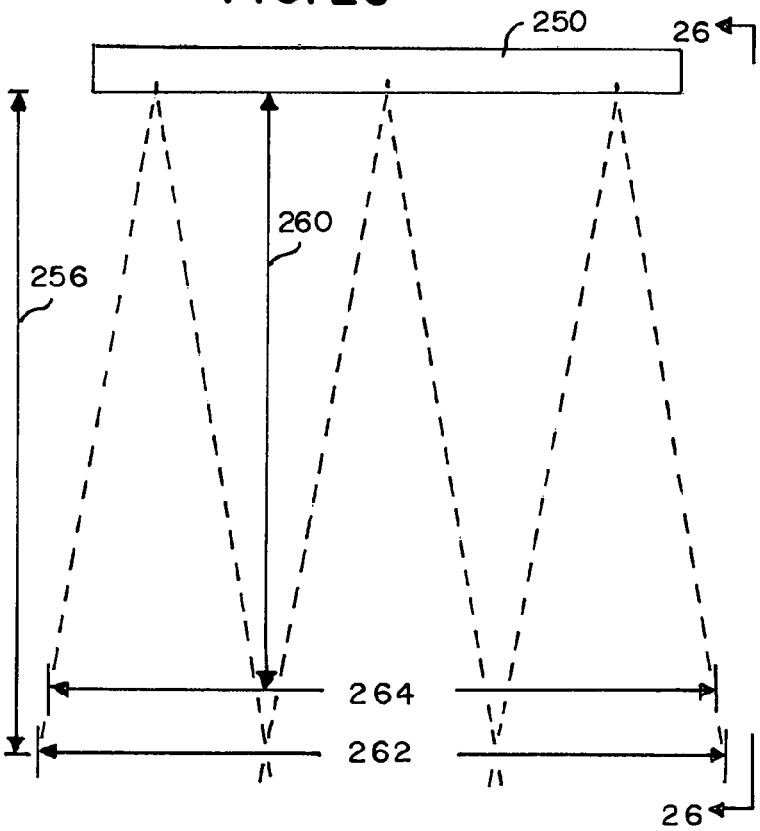
FIG. 25 is an side elevational view showing the field of view ("FOV") of three thermopile detectors of three sensor modules of the present invention.
Figure 26:
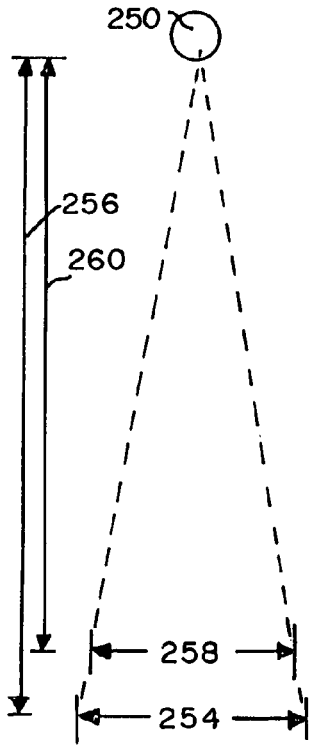
FIG. 26 is an end elevational view showing the field of view of a thermopile detector of the present invention, taken substantially along the line 26-26 shown in FIG. 25.

As shown in FIG. 25, the adjacent fields of view for the thermopile detectors overlap to at about a distance of 40 inches (102 cm.), as do the fields of view for thermopile matrix 200 heretofore described, thereby providing an elongated composite field of view length 262 of about 42.1 inches (107 cm.) at a distance 256 of 40 inches (102 cm.) and an elongated composite field of view length 264 of about 40.7 inches (103 cm.) at a distance 260 of 36 inches (91.4 cm.).

FIG. 29 shows a block diagram of the various major parts of hazard monitoring and suppression apparatus 250. In accordance with usual conventions for signal naming in digital logic circuits, those signals that are asserted low ("negative logic") are prefaced on the schematics with the character "/" before their names. As hereinafter described in detail, apparatus 250 has in internal 6 volt battery ("BATT") that is used to power the internal circuitry and to charge the discharge capacitors, thereby making apparatus 250 self-contained and self-powered over an extended lifetime. An optional 24 volt battery ("24 V IN") supplies power to apparatus 250 when an operator's panel 268 is provided, and provides power for the operator's panel and for the circuitry in the event that it is present. An operator's panel ("crew panel") 268 is preferably provided with various status light emitting diodes ("LEDs") for indicating the status of the apparatus 250. LED 270 ("GOOD") provides an indication that the system health is fine and operational, is preferably colored green to indicate a safe condition, and is driven by the signal "/SYSTEM GOOD", hereinafter described in detail. LED 272 ("INOP") provides a warning that a system failure has occurred, is preferably colored red to indicate an unsafe condition, and is the logical inverse of what is shown by LED 270. LED 272 and 270 are both provided so that one of them will be on at all times, indicating that the system is functioning properly and is monitoring its own health. LED 274 ("DCHG") provides a warning that the tank 24 has become discharged, is preferably colored red to indicate an unsafe condition, and is driven by the signal "/LOW PRESS", hereinafter described in detail. LED 276 ("FIRE") provides a warning that a fire has been detected, is preferably colored red to indicate an unsafe condition, and is driven by the signal "/FIRE DET", hereinafter described in detail. Normally-open pushbutton SW4 ("MAN RLSE") is provided as a way for the operator to manually actuate the suppressant release solenoids SOL1 and SOL2 that actuate the single-action discharge valves of the present invention, hereinbefore described, by applying 24 volts from the vehicle battery to the signal DISCHG.

Figure 31:
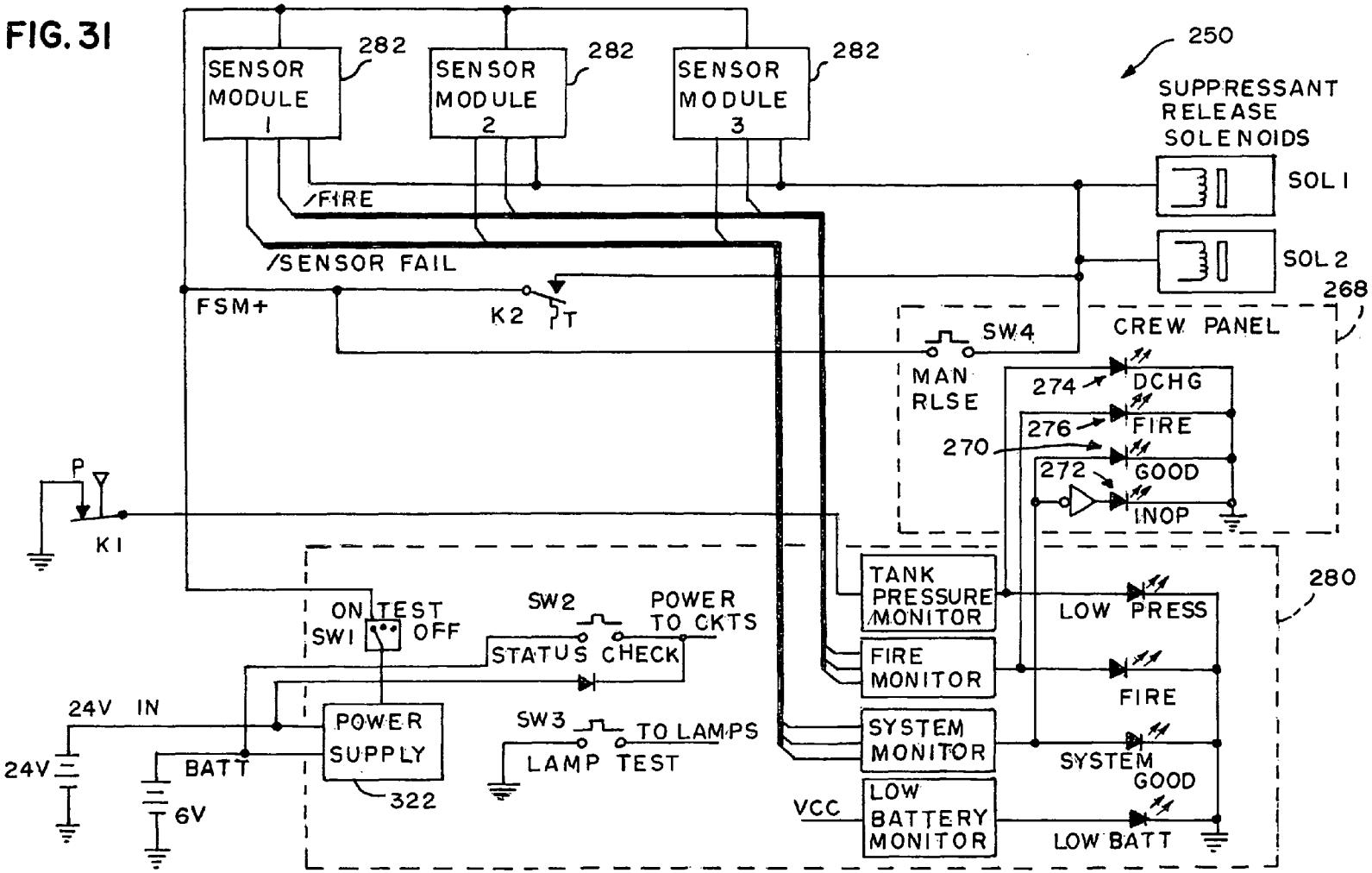
FIG. 31 is a schematic block diagram of the fire extinguisher system of the present invention, similar to FIG. 29 but showing greater detail.

Pressure switch K1 is preferably an S2380-3 pressure switch manufactured by Spectrum Associates, Inc., 183 Plains Rd., Milford Conn. 06461-2420, and monitors the pressure within the suppressant tank 24. Pressure switch K1 is selected to trip at 165 pounds per square inch ("PSI") falling, such that the switch is normally closed as shown in FIGS. 29 and 31 when the suppressant tank 24 is pressurized.

Thermostat switch K2 is preferably a 5004 Series thermostat switch operated by a bimetal disc with positive reinforce snap-action, manufactured by Airpax, 550 Highland St., Frederick, Md. 21701, and is a fail-safe monitor of the ambient temperature that can cause the suppressant release valves to discharge the contents of the suppressant tank 24 if the sensor modules, hereinafter described in detail, fail to detect a fire or overtemperature condition. Thermostat switch K2 is normally open as shown in FIGS. 29 and 31, and is selected to close when the ambient temperature rises above 300 degrees Fahrenheit (149 degrees Celsius). Switch K2, when closed, has the same function as manual operation of SW4, and causes the single-action discharge valves of the present invention to be actuated, thereby causing release of suppressant material from the pressurized tank.

Apparatus 250 further comprises a system status and reporting module ("SRM") 280 and a plurality, preferably three, sensor modules 282, for detecting a hazard, and each sensor module 282 is identical. It should be understood that more or fewer than three sensor modules 282 may be provided, as desired. In the example of the preferred embodiment of apparatus 250 described hereinbelow, the sensor modules 282 ("FSM #1", "FSM #2", "FSM #3") are fire sensor modules and detect a fire condition using thermopile detectors T1, T2, and T3, respectively, hereinbefore described. However, it should be understood that other hazards, such as biological or biological agent hazards, radiation hazards, poisonous chemical hazards, and the like, could be monitored and suppressed using the apparatus of the present invention by a replacement of thermopile detectors T1, T2, and T3 with appropriate well-known detectors for biological, radiation, or poisonous chemical hazards, and by appropriate replacement of the suppressant released by the discharge valves of the present invention. Likewise, the present invention can monitor a combination of hazards, such as fire and radiation hazards, biological and poisonous chemical hazards, etc., by having some of the sensor modules detect one type of hazard and having other of the sensor modules detect another type of hazard, with a plurality of suppressants being released from multiple tanks filled with suppressant material or from a single tank filled with multiple-agent suppressant material.

System status and reporting module 280 preferably includes a double-pole three-position keyswitch SW1, hereinafter described in detail, for placing apparatus 250 in one of three modes: an "Off" mode, in which all voltage is removed from the circuitry of apparatus 250 so that the internal battery BATT does not become drained and so that the solenoid valves SOL1 and SOL2 cannot be actuated to release suppressant material from the pressurized tank; a "Test" mode, in which, as hereinafter described in detail, some circuitry of apparatus is powered to permit testing of the sensor modules 282, and some circuitry is unpowered to prevent actuation of solenoid valves SOL1 and SOL2 when a fire condition is simulated by placing a heat source in front of each of the thermopile detectors T1, T2, and T3; and an "On" mode in which apparatus 250 performs its intended function of detecting and suppressing a hazard condition by actuating solenoid valves SOL1 and SOL2 when a fire condition is detected by one of the thermopile detectors T1, T2, and T3.

System status and reporting module 280 preferably also includes a number of indicators, preferably LEDs, to indicate successful operation of system status and reporting module 280 or to indicate an alarm or failure condition. It should be understood, as hereinafter described in detail, that most of the circuitry of apparatus 250 is unpowered during normal operation in order to conserve battery power, so none of the indicators 284, 286, 288, or 290 will be functional unless and until SW2 ("STATUS CHECK"), hereinafter described, is depressed. LED 284 ("LOW BATT") provides a warning that the internal battery voltage is below its acceptable voltage and needs to be replaced, is preferably colored red to indicate an unsafe condition, and is driven by the signal "/LOW BATT", hereinafter described in detail. LED 286 ("SYSTEM GOOD") provides an indication that the system health is fine and operational, is preferably colored green to indicate a safe condition, and is driven by the signal "/SYSTEM GOOD", hereinafter described in detail. LED 288 ("LOW PRESS") provides a warning that the tank 24 has become discharged, is preferably colored red to indicate an unsafe condition, and is driven by the signal "/LOW PRESS", hereinafter described in detail. LED 290 ("FIRE DETECT") provides a warning that a fire has been detected, is preferably colored red to indicate an unsafe condition, and is driven by the signal "/FIRE DET", hereinafter described in detail.

Pushbutton SW2 ("STATUS CHECK") is provided to interrogate the status of apparatus 250 during normal operation, when most of the circuitry of apparatus 250 is unpowered to conserve battery power. Depressing pushbutton SW2 causes power to be applied to all of the circuits, causing LEDs 284, 286, 288, and/or 290 to become illuminated to display the proper system status, as appropriate. Pushbutton SW3 ("LAMP TEST") is provided to test LEDs 284, 286, 288, and 290 by causing all of LEDs 284, 286, 288, and 290 to become illuminated for observation regardless of the state of the signals that normally drive those LEDs. When apparatus 250 is operating on internal power only from the internal 6 volt battery BATT without power from the external 24 volt battery of the vehicle being applied, it is necessary also to depress the STATUS CHECK pushbutton SW2, so that power is applied to the circuitry and LEDs of apparatus 250, while depressing the LAMP TEST pushbutton SW3 in order to check the functioning of LEDs 284, 286, 288, and 290.

Preferably, rotary keyswitch SW1, pushbuttons SW2, SW3, and LEDs 284, 286, 288, and 290 are located behind a hinged protective panel (not shown) that is latched with a quarter-turn latchscrew (not shown) so as to prevent unintended changes to keyswitch SW1 and to prevent accidental actuation of pushbuttons SW2 and SW3.

Figure 28:
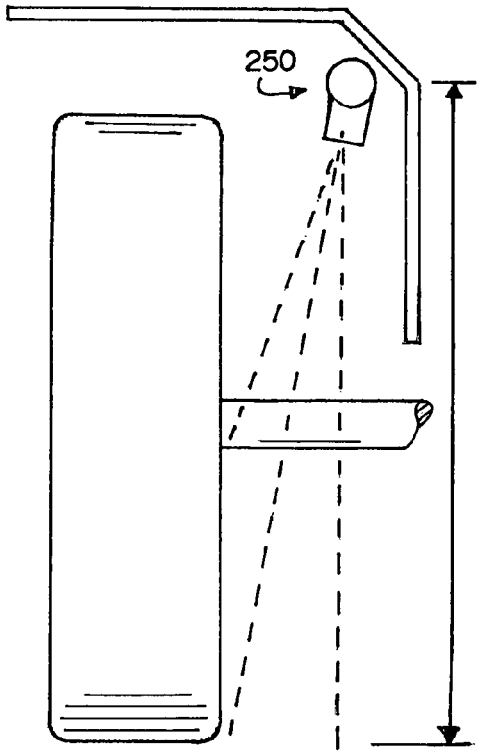
FIG. 28 is an end elevation view of a vehicle with a fire extinguisher system of the present invention installed under a fender of the vehicle, with the fire extinguisher system monitoring and protecting a wheel and axle of the vehicle, taken substantially along the line 28-28 shown in FIG. 24.
Figure 30:
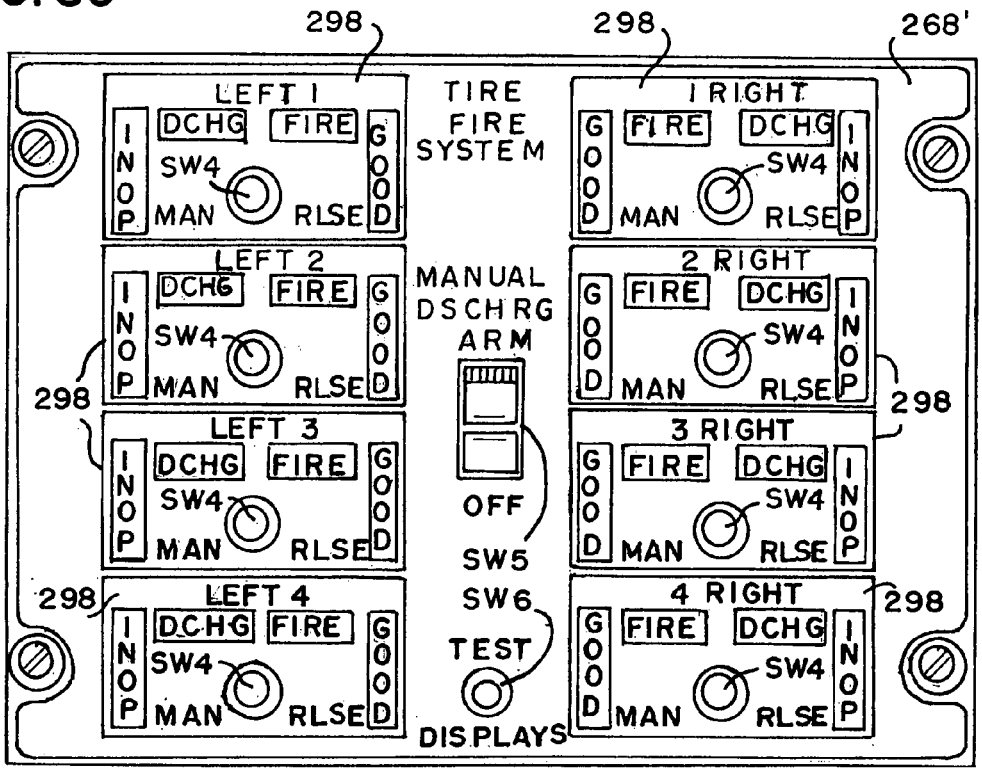
FIG. 30 is a front view of a second embodiment of the crew panel of the present invention when used with a plurality of fire extinguishers of the present invention.

Referring to FIGS. 24, 28, and 30, use of the apparatus 250 to monitor and suppress fire hazards for a plurality of tires and axles of a large vehicle can now be described in detail, as would be used when it is desired to monitor and protect a vehicle from incendiary devices, etc.

In such an application, a plurality of monitoring and suppression apparatus 250 are mounted under the fender 292 of a vehicle, positioned so that the tire 294 and axle 296 are within the composite field of view of the apparatus 250. As heretofore described, the lens for each thermopile detector can be selected to present a desired angle of view for the thermopile detectors as appropriate for the field of view distance from the apparatus 250 to the target tire 294 and axle 296. When a plurality of apparatus 250 are used, the operator's panel of the single-apparatus 250 embodiment shown in FIG. 29 is preferably modified to be operator's panel 268' shown in FIG. 30, which presents a plurality of sub-panels 298, each substantially similar to operator's panel 268 and each presenting indicators and an actuation pushbutton for a respective apparatus 250 in the manner heretofore described for operator panel 268. Operator's panel 268' preferably includes a two-position switch SW5 that, when in the "ARM" position, supplies 24 volts from the vehicle battery to one side of each "MAN RLSE" pushbutton SW4, so as to enable generation of the respective DISCHG signals that actuate respective solenoid discharge valves of each respective apparatus 250. When SW5 is in the "Off" (or safety) position, 24 volts is removed from one side of each "MAN RLSE" pushbutton SW4, thereby preventing any SW4 from actuating its respective solenoid discharge valve of its respective apparatus 250. Operator's panel 268' also preferably includes a "TEST DISPLAYS" pushbutton SW6 to simultaneously illuminate all four of the indicator LEDs for each sub-panel 298 when performing a system integrity check.

FIG. 31 is a more detailed schematic block diagram of apparatus 250 shown in FIG. 29, and shows the interconnection of the various modules and showing somewhat greater detail in the schematic for apparatus 250. With reference to FIG. 31, the detailed schematics and operation of the sensor modules 282 and the system status and reporting module 280 can now be described and explained.

Figure 32:
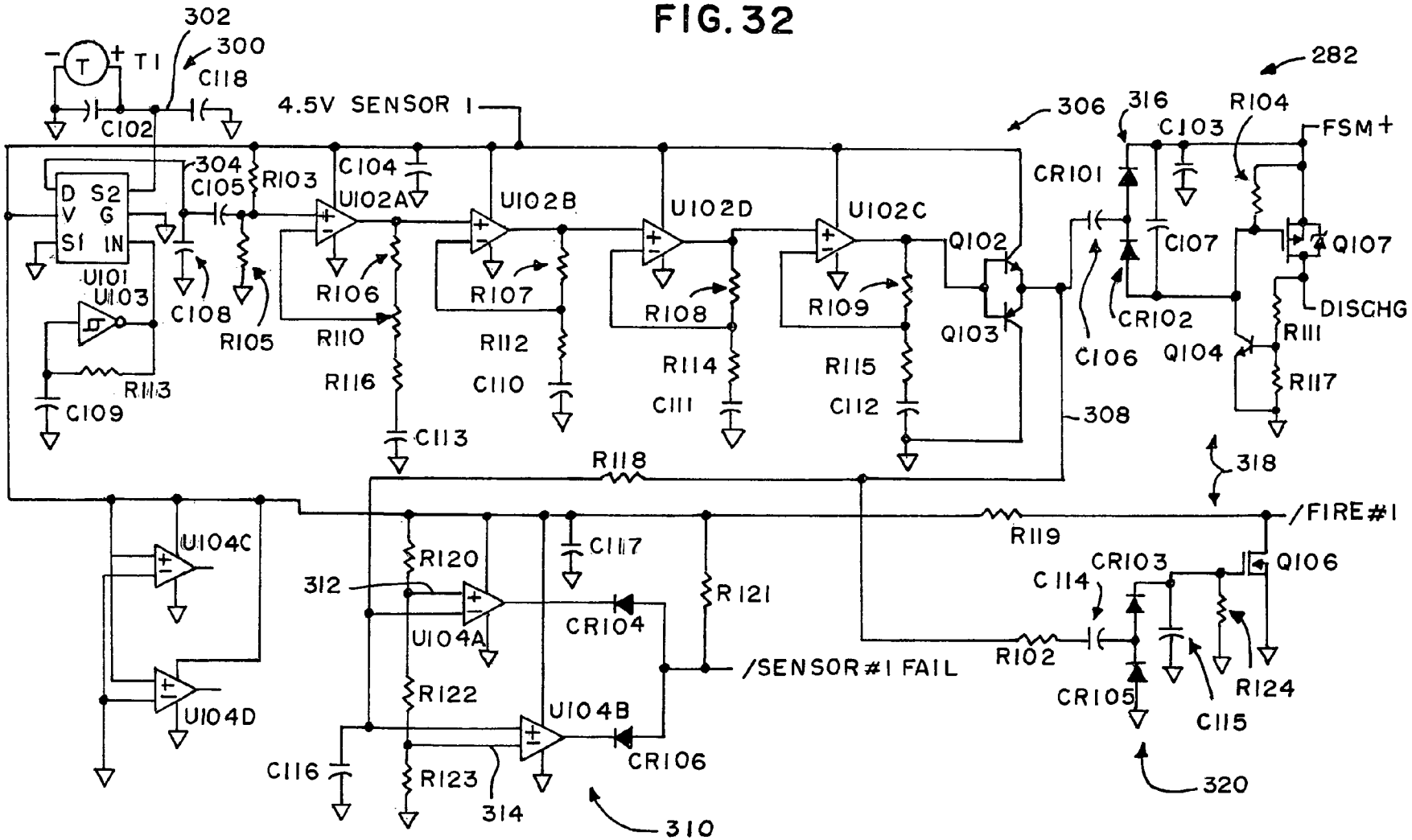
FIG. 32 is a schematic of a sensor module of the present invention.
Figure 33A:
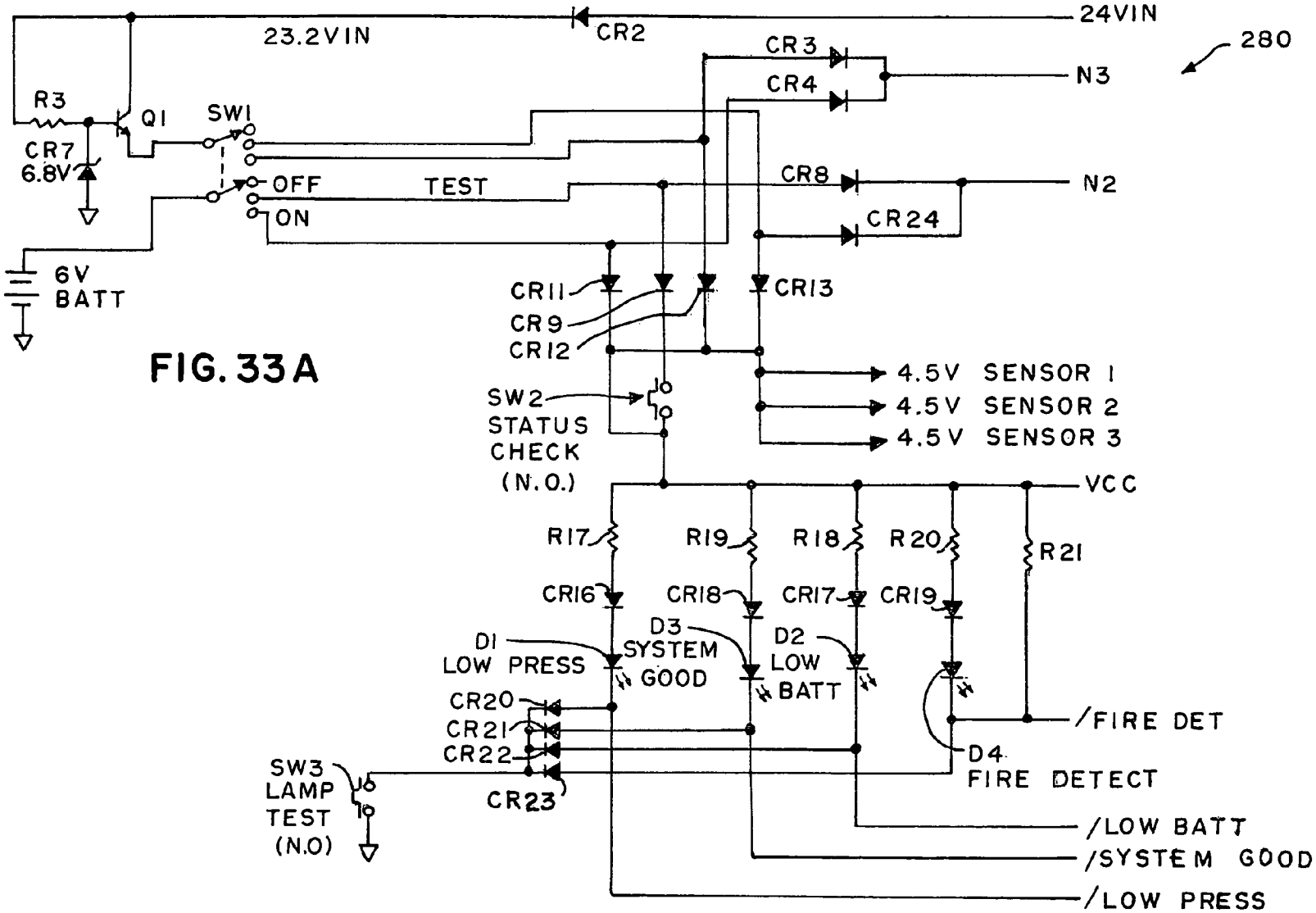
FIGS. 33A, 33B, and 33C, placed in sequence left to right, together comprise a schematic of the system status and reporting module ("SRM").
Figure 33B:
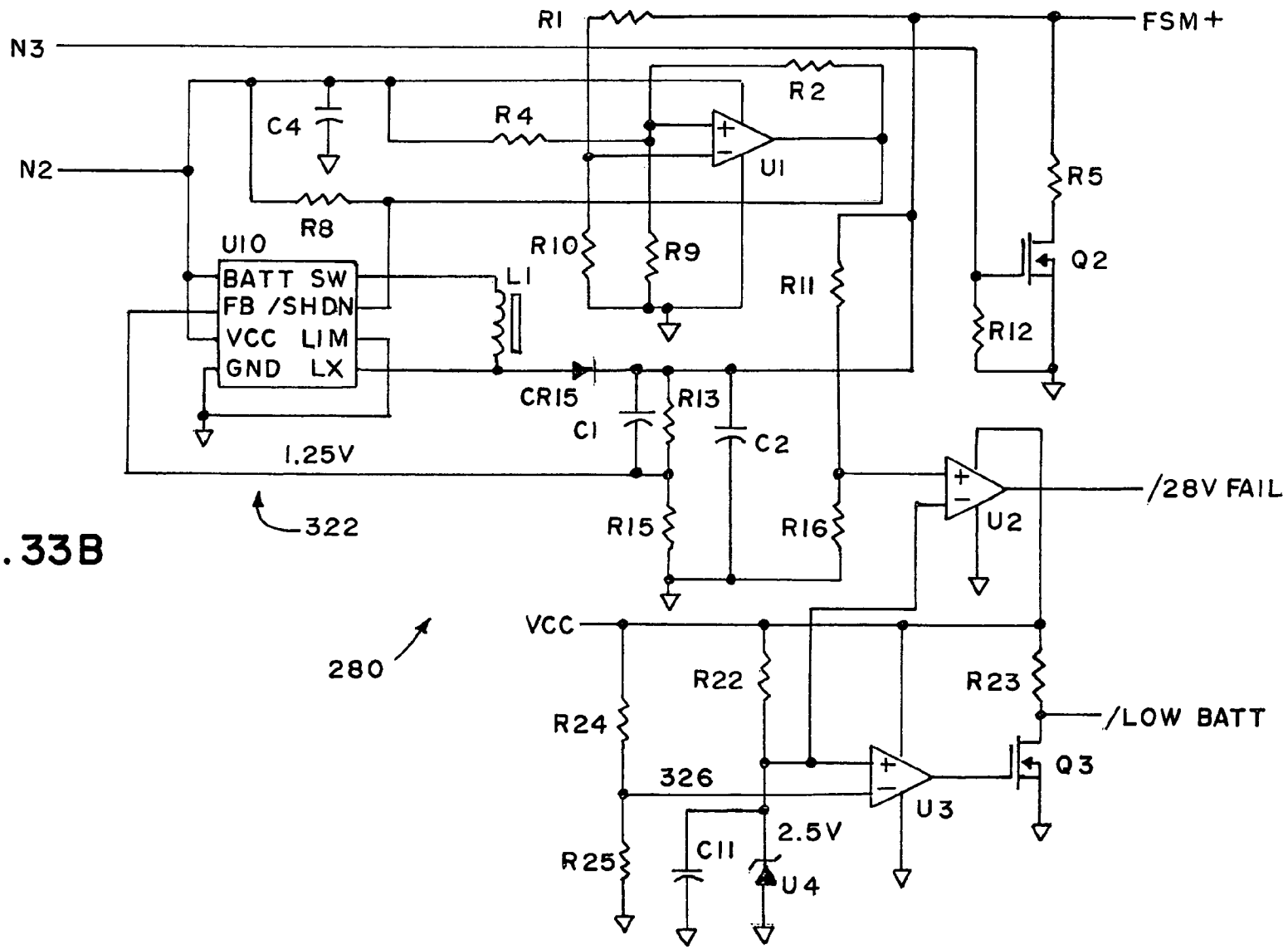
Figure 33C:
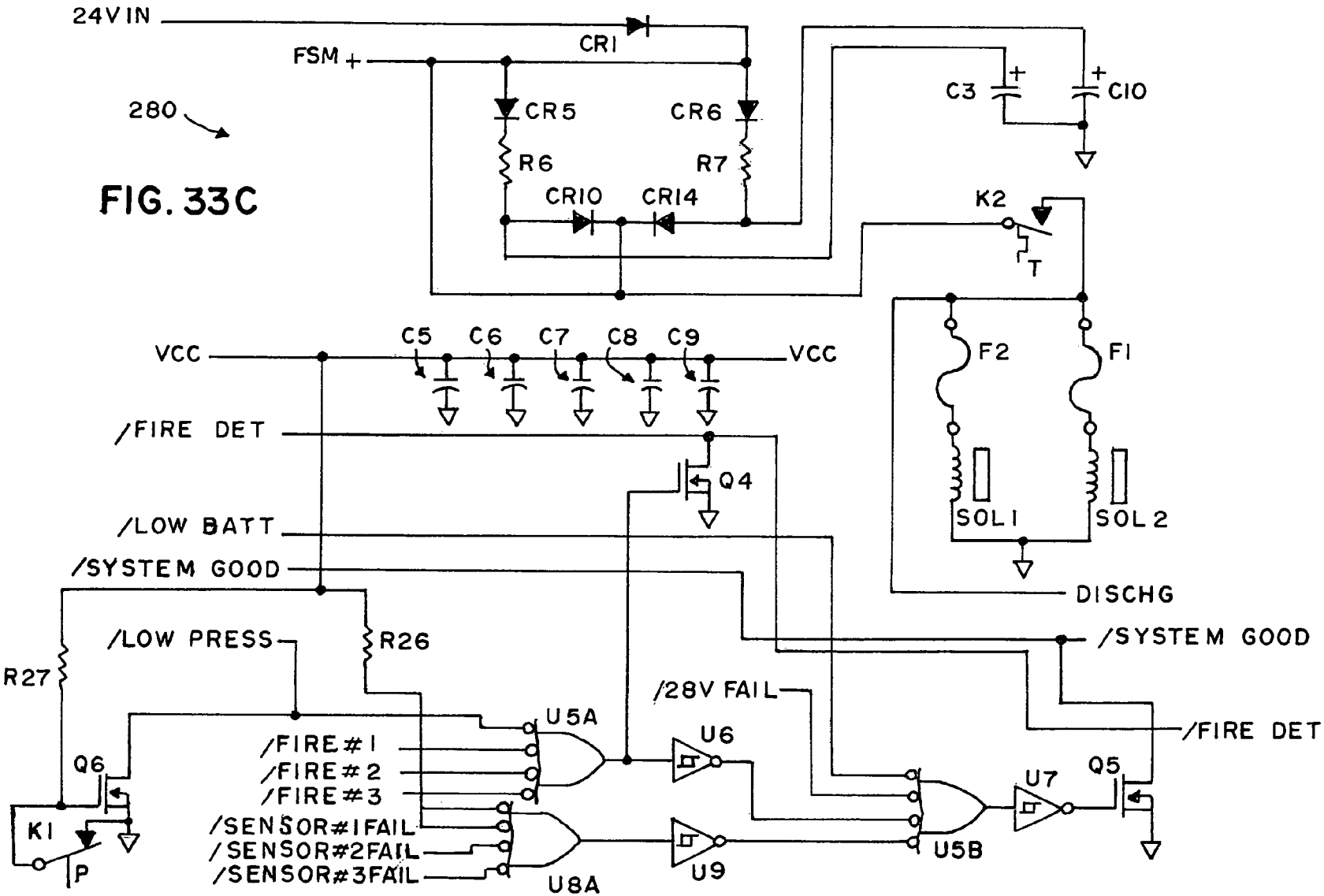

FIG. 32 shows a schematic diagram of a sensor module 282 of the present invention. It shall be understood that all three sensor modules 282 ("FSM #1", "FSM #2", and "FSM #1") are identical, and a description of FSM #1 will suffice for all of the sensor modules 282. It shall be understood that the input voltage supply line ("4.5V SENSOR1") originates from the power supply of system status module 280 and is common to all of the sensor modules. The input voltage supply line is given a separate signal name (e.g., "4.5V SENSOR1", "4.5V SENSOR2", and "4.5V SENSOR3") for each sensor module 282 for clarity because a separate supply wire is preferably provided for each supply module to aid troubleshooting and to provide separate current paths for the power supplied to each sensor module. The signal "FSM+" is common to all sensor modules 282 and provides the power that is used to actuate the solenoid valves. The signal "DISCHG" is common to all sensor modules 282 and, when asserted high to the level of FSM+ by an over-temperature condition detected by temperature sensor K2 or by actuation by any one of the sensor modules 282, or when brought to 24 volts by manual actuation of the "MAN RLSE" (manual release) pushbutton SW4 of the crew panel, causes the solenoid valves of apparatus 250 to discharge. Each sensor module 282 outputs a first alarm signal, asserted low and hereinafter described in detail, indicating that the sensor module 282 has detected a "hazard" condition. This first alarm signal is respectively denoted as "/FIRE#1", "/FIRE#2", and "/FIRE#3" for the three sensor modules 282. Likewise, each sensor module 282 outputs a second alarm signal, asserted low and hereinafter described in detail, indicating that the sensor module 282 has detected failure of its amplifiers. This second alarm signal is respectively denoted as "/SENSOR#1FAIL", "/SENSOR#2FAIL", and "/SENSOR#3FAIL" for the three sensor modules 282.

The various components of sensor module 282 will first be listed in a sequence of tables, followed by a description of the structure and operation of the circuitry for sensor module 282. Table 1 shows the resistors and their values:

TABLE 1

Resistors for Sensor Module

| Ref. Numeral | Value |
|---|---|
| R102 | 10 Ohms |
| R103 | 1 Meg Ohm |
| R104 | 100 K Ohm |
| R105 | 1 Meg Ohm |
| R106 | 100 K Ohm |
| R107 | 100 K Ohm |
| R108 | 100 K Ohm |
| R109 | 100 K Ohm |
| R110 | 100 K Ohm Potentiometer |
| R111 | 1 K Ohm |
| R112 | 30.1 K Ohm |
| R113 | 100 K Ohm |
| R114 | 30.1 K Ohm |
| R115 | 30.1 K Ohm |
| R116 | 5.11 K Ohm |
| R117 | 100 K Ohm |
| R118 | 1 Meg Ohm |
| R119 | 100 K Ohm |
| R120 | 1 Meg Ohm |
| R121 | 200 K Ohm |
| R122 | 2.4 Meg Ohm |
| R123 | 1 Meg Ohm |
| R124 | 1 Meg Ohm |

Table 2 shows the capacitors and their values for each Sensor Module:

TABLE 2

Capacitors for Sensor Module

| Ref. Numeral | Value |
|---|---|
| C102 | 4.7 μF |
| C103 | 10 μF, 50 Volts |
| C104 | 0.1 μF |
| C105 | 1.0 μF |
| C106 | 1.0 μF |
| C107 | 2.2 μF |
| C108 | 0.01 μF |
| C109 | 0.1 μF |
| C110 | 4.7 μF |
| C111 | 4.7 μF |

TABLE 2-continued

Capacitors for Sensor Module

| Ref. Numeral | Value |
|---|---|
| C112 | 4.7 μF |
| C113 | 4.7 μF |
| C115 | 1 μF, 25 Volts |
| C116 | 1.0 μF |
| C117 | 0.1 μF |
| C118 | 1000 pF |

Table 3 shows the integrated circuits and their values for each Sensor Module:

TABLE 3

Integrated Circuits for Sensor Module

| Ref. Numeral | Value |
|---|---|
| U101 | ADG752 |
| U102A | OP481 |
| U102B | OP481 |
| U102C | OP481 |
| U102D | OP481 |
| U103 | 74AHC1G14/SOT |
| U104A | OP481 |
| U104B | OP481 |
| U104C | OP481 |
| U104D | OP481 |

Table 4 shows the diodes and their values for each Sensor Module:

TABLE 4

Diodes for Sensor Module

| Ref. Numeral | Value |
|---|---|
| CR101 | MMSD914 |
| CR102 | MMSD914 |
| CR103 | MMSD914 |
| CR104 | MMSD914 |
| CR105 | MMSD914 |
| CR106 | MMSD914 |

Table 5 shows the transistors and the thermopile detector, and their values, for each Sensor Module:

TABLE 5

Miscellaneous Parts for Sensor Module

| Ref. Numeral | Type | Value |
|---|---|---|
| T1 | Thermopile Detector | Dexter Research ST60 series |
| Q102 | Transistor | FMMT491 |
| Q103 | Transistor | FMMT551 |
| Q104 | Transistor | FMMT491 |
| Q106 | Transistor | 2N7002 |
| Q107 | Transistor | 1RF9530N/TO 2 |

Thermopile detector T1 is as previously described hereinabove in connection with FIGS. 22, 23, 25, and 26, and is understood to be sensor means 300 having an output signal 302 representing a hazard parameter, specifically, the optical energy in the near-infrared region between about 0.2 microns to 10 microns, inclusive, and preferably in the range between about 2 to 10 microns, inclusive. Schmidt trigger inverter U103, with a time constant set by resistor R113 and capacitor C109, is a low-frequency free-running oscillator that controls analog switch U101, which switches node 304 between ground and the value of output signal 302, at about 100 Hz, thereby modulating output signal 302 into a square wave modulated signal at node 304 that has a peak-to-peak value equal to the DC output of T1. Typical peak-to-peak values are about 1.5 mV for a temperature of 300 degrees Fahrenheit (149 degrees Celsius). Switch U101 is thus seen to be modulation means for producing a modulated signal at node 304 from output signal 302.

The modulated signal at node 304 then passes through capacitor C105 to a DC coupled AC amplifier means 306 whose input is biased at a DC level of one-half the supply voltage 4.5V SENSOR1 by equal-value resistors R103 and R105. Amplifier means 306 is comprised of four cascaded very-low-current operational amplifiers U102A, U102B, U102D, and U102C having a DC gain of 1 and having an adjustable AC gain, set by R110, that is about 80 through the four stages through output transistors Q103 and Q102. Because the DC gain of amplifier means 306 is unity, the amplified signal 308 produced by the output transistors Q103 and Q102 has an AC component that is an amplified version, with limited rise and fall times due to the frequency response of the cascaded amplifiers, of the square wave signal 304, superimposed on a DC component that is still one-half the supply voltage 4.5V SENSOR1. Preferably R110 is adjusted using a calibration procedure as hereinafter described so that, when a standard known temperature at the desired trip point is viewed by thermopile T1, the /FIRE#1 signal just becomes asserted. The advantage of using an AC-coupled amplifier is that any offset voltage is cancelled out, producing an output that is amplified by the AC gain of the amplifier means 306. As long as all of amplifiers U102A, U102B, U102D, and U102C remain operational and healthy, the DC component of amplified signal 308 will remain at substantially one-half the supply voltage 4.5V SENSOR1. However, if any of these operational amplifiers fail, the DC component of the amplified signal 308 will drift from this center value toward one of the supply rails for the amplifiers. R118 and C116 form a low-pass filter that substantially blocks the AC component of amplified signal 308 and passes the DC component of signal 308 to comparators U104A and U104B. Accordingly, sensor module 282 includes comparator means 310 having upper and lower thresholds 312, 314 set by resistor ladder R120, R122, and R123 preferably at 3.5 volts and 1.0 volt, respectively (i.e., one volt inside each of the supply rails), and amplified signal 308 is compared against these two thresholds. If the amplified signal 308 drifts above the upper threshold 312 or below the lower threshold 314, comparator means 310 will assert the signal /SENSOR#1FAIL to indicate that sensor module 282 has failed.

The AC component of amplified signal 308, having an amplitude proportional to the thermopile's output signal 302, typically has a peak-to-peak amplitude of about four volts and is AC coupled through capacitor C106 to an AC to DC detector 316 formed by diodes CR101 and CR102, and, when the amplitude of the AC component of the amplified signal is large enough, indicating that a fire condition has been detected by thermopile T1, capacitor C107 becomes sufficiently charged to turn on solenoid driver FET Q107, thereby connecting the signal DISCHG to node FSM+, which permits the energy storage capacitors C3 and C10, shown on the schematics for the system status and reporting module 280, to discharge through and thus energize solenoids SOL1 and SOL2, thereby actuating the discharge valve 20 of the present invention so as to discharge the pressurized suppressant contents of tank 24. The circuit of transistor Q104 acts to enhance the turn-on speed of FET Q107. AC to DC detector 316, together with transistors Q107 and Q104 and their associated circuitry, are thus seen to be control means 318 responsive to the fire hazard parameter, namely, the measured optical energy in the near-infrared region, for selectively connecting capacitors C3 and C10 to solenoids SOL1 and SOL2 for actuation of their respective discharge valves when a fire hazard is present.

In a similar manner, the AC component of amplified signal 308 is also preferably AC coupled through capacitor C114 to another AC to DC detector 320 formed by diodes CR103 and CR105, and Q106 is caused to assert the hazard detection signal /FIRE#1, indicating that sensor module 282 has detected the existence of a fire hazard condition, when the amplitude of the AC component of the amplified signal becomes large enough to trigger Q106. Control means 318 is thus seen to preferably be further for asserting hazard detection signal /FIRE#1 when the AC component of amplified signal 308 is greater than a certain value, as with AC to DC detector 316. Unused operational amplifiers U104C and U104D have their inputs tied to the supply rails so as not to generate noise and draw extra power.

To calibrate sensor module 282, a heat source of the desired trip point temperature, typically about 300 degrees Fahrenheit (149 degrees Celsius), is presented to thermopile T1 with the solenoid valves SOL1 and SOL2 disconnected, and gain resistor R110 is adjusted for the proper tripping of AC to DC detectors 316, 318 at the desired temperature.

The various components of system status and reporting module 280 will first be listed, followed by a description of the structure and operation of the circuitry for system status and reporting module 280.

Table 6 shows the integrated circuits and their values for system status and reporting module 280:

TABLE 6

Integrated Circuits for Status Reporting Module

| Ref. Numeral | Value |
|---|---|
| U1 | ADCMP371 Comparator |
| U2 | ADCMP371 Comparator |
| U3 | ADCMP371 Comparator |
| U4 | LM285-2.5/SO 2.5 V Zener Diode |
| U5A | 74HC20 NAND |
| U5B | 74HC20 NAND |
| U6 | 74AHC1G14/SOT Inverter |
| U7 | 74AHC1G14/SOT Inverter |
| U8A | 74HC20 NAND |
| U9 | 74AHC1G14/SOT Inverter |
| U10 | MAX1606 Power Supply Conroller |

Table 7 shows the diodes and their values:

TABLE 7

Diodes for Status Reporting Module

| Ref. Numeral | Value |
|---|---|
| CR1 | MMSD914 |
| CR2 | MMBD914 |
| CR3 | MMSD914 |
| CR4 | MMSD914 |
| CR5 | MMSD914 |
| CR6 | MMSD914 |
| CR7 | MMSZ-5235B 6.8 V Zener |
| CR8 | MMSD914 |
| CR9 | MMSD914 |
| CR10 | MURA140T3 |
| CR11 | MMSD914 |
| CR12 | MMSD914 |

TABLE 7-continued

Diodes for Status Reporting Module

| Ref. Numeral | Value |
|---|---|
| CR13 | MMSD914 |
| CR14 | MURA140T3 |
| CR15 | MMSD914 |
| CR16 | MMSD914 |
| CR17 | MMSD914 |
| CR18 | MMSD914 |
| CR19 | MMSD914 |
| CR20 | MMSD914 |
| CR21 | MMSD914 |
| CR22 | MMSD914 |
| CR23 | MMSD914 |
| CR24 | MMSD914 |

Table 8 shows the resistors and their values for status and reporting module 280:

TABLE 8

Resistors for Status Reporting Module

| Ref. Numeral | Value |
|---|---|
| R1 | 7.5 Meg Ohm |
| R2 | 10 Meg Ohm |
| R3 | 3 K Ohm, ¼ Watt |
| R4 | 1 Meg Ohm |
| R5 | 100 Ohm |
| R6 | 5.1 K Ohm |
| R7 | 5.1 K Ohm |
| R8 | 1 Meg Ohm |
| R9 | 1 Meg Ohm |
| R10 | 732 K Ohm |
| R11 | 4.7 Meg Ohm |
| R12 | 10 K Ohm |
| R13 | 4.4 Meg Ohm |
| R15 | 200 K Ohm |
| R16 | 500 K Ohm |
| R17 | 1 K Ohm |
| R18 | 1 K Ohm |
| R19 | 1 K Ohm |
| R20 | 1 K Ohm |
| R21 | 100 K Ohm |
| R22 | 200 K Ohm |
| R23 | 200 K Ohm |
| R24 | 511 K Ohm |
| R25 | 866 K Ohm |
| R26 | 100 K Ohm |

Table 9 shows the capacitors and their values for the system status and reporting module 280:

TABLE 9

Capacitors for Status Reporting Module

| Ref. Numeral | Value |
|---|---|
| C1 | 10 pF |
| C2 | 1.0 μF |
| C3 | 4400 μF, 50 Volts |
| C4 | 0.01 μF |
| C5 | 0.01 μF |
| C6 | 0.01 μF |
| C7 | 0.01 μF |
| C8 | 0.01 μF |
| C9 | 0.01 μF |
| C10 | 4400 μF, 50 Volts |
| C11 | 0.1 μF |

Table 10 shows an assortment of parts, their type, and their values for the system status and reporting module:

TABLE 10

Miscellaneous Parts for Status Reporting Module

| Ref. Numeral | Type | Value |
|---|---|---|
| SW1 | Switch | Rotary 2 Pole, 3 Position |
| SW2 | Switch | Pushbutton, N.O. |
| SW3 | Switch | Pushbutton, N.O. |
| Q1 | Transistor | FMMT491 |
| Q2 | Transistor | FQT13N06L |
| Q3 | Transistor | 2N7002 |
| Q4 | Transistor | 2N7002 |
| Q5 | Transistor | 2N7002 |
| Q6 | Transistor | 2N7002 |
| D1 | LED | |
| D2 | LED | |
| D3 | LED | |
| D4 | LED | |
| K1 | Pressure Switch | Spectrum S2380-3 (165 PSI) |
| K2 | Temperature Switch | 300° F. - Airpax 5004 |
| SOL1 | Valve Solenoid | |
| SOL2 | Valve Solenoid | |
| L1 | Inductor | 10 μH |
| F1 | Fuse | 10 A, 32 V, Fast-Acting |
| F2 | Fuse | 10 A, 32 V, Fast-Acting |

Pressure switch K1 is preferably an S2380-3 pressure switch as hereinbefore described. If the suppressant tank 24 loses pressure or becomes discharged, pressure switch K1 opens and causes transistor Q6 to assert the signal /LOW PRESS, which causes low pressure indicator LED D1 to become illuminated, and which causes, through NAND gate U5A and transistor Q4, the signal /FIRE DET to be asserted. Likewise, assertion of any of the fire hazard detection signals /FIRE#1, /FIRE#2, or /FIRE#3 will cause NAND gate U5A and transistor Q4 to assert the /FIRE DET signal. Assertion of any of the sensor module failure signals /SENSOR#1FAIL, /SENSOR#2FAIL, or /SENSOR#3FAIL, or assertion of any of the fire hazard detection signals /FIRE#1, /FIRE#2, or /FIRE#3, or assertion of the signal /LOW PRESS, or assertion of the power supply failure signal /28V FAIL, or assertion of the low battery signal /LOW BATT, causes transistor Q5 to indicate a system failure by removing the assertion of the signal /SYSTEM GOOD.

Thermostat switch K2 is preferably a 5004 Series thermostat switch as hereinbefore described. If the ambient temperature rises above the 300 degrees Fahrenheit trip point of thermostat switch K2, this switch closes and allows energy storage capacitors C3 and C10 to discharge through diodes CR10 and CR14 and then through solenoids SOL1 and SOL2, thereby causing actuation of the discharge valves of the present invention in a manner hereinbefore described.

Switch SW1, a two-pole, three-position switch, has three positions: "Off", "Test", and "On". When in the "Off" position, neither the internal 6 volt battery BATT, which is connected to one of the poles of SW1, nor the approximately six-volt voltage source created by Zener diode CR7, R3, and Q1 from the optional vehicle battery source 24V IN, and connected to the other pole of SW1, is connected to the rest of the circuit, which remains unpowered. When SW1 is placed into the "On" position, the sensor supply voltage signals 4.5V SENSOR1, 4.5V SENSOR2, and 4.5V SENSOR3 are powered from either the internal 6 volt battery BATT or the generated 6 volt source at the emitter of Q1.

A 28 volt power supply 322 is provided that is a 6 volt to 28 volt converter that is used when the apparatus 250 is operating from internal 6 volt battery BATT, and it supplies approximately 28 volts at node FSM+. Power supply 322 comprises integrated circuit U10, inductor L1, and diode CR15. When the energy storage capacitors C3 and C10 become fully charged through CR5, R6 and CR6, R7 to 28 volts, that voltage is sensed by comparator U1 at resistor divider R1, R10 and U1 then asserts the shutdown input /SHDN to integrated circuit U10, which causes the power supply to go into standby mode, thereby reducing the power supply current to about 1 μA, thereby conserving the life of the 6 volt internal battery BATT. Power supply 322 is thus seen to have a charging mode in which it charges capacitors C3 and C10 with a supply of energy, and also to have a standby mode in which it substantially stops charging capacitors C3 and C10, and U1 is seen to provide control means 324 for causing power supply 322 to enter the standby mode when capacitors C3 and C10 become charged to a certain predetermined voltage, thereby causing power supply 322 to draw substantially less power from 6 volt battery BATT.

When switch SW1 is placed in the "Test" mode, transistor Q2 is turned on by node N3, thereby discharging the storage capacitors and permitting testing of the storage modules 282 in a manner hereinbefore described, and transistor Q2 is thus seen to be discharge means 324 for selectively discharging the supply of energy from capacitors C3 and C10, and discharge means 324 is seen to be caused to discharge capacitors C3 and C10 when apparatus 250 is placed into the test mode. Furthermore, when in the "Test" mode, all circuitry becomes powered except for the 28 volt power supply 322, and, if a 24 volt vehicle battery is used to supply power through 24V IN, the 28 volt supply is disconnected from the solenoid drivers.

Comparator U2 monitors the health of the 28 volt supply through resistor divider R11 and R16, comparing that voltage against the voltage at node 326 formed by resistor divider R24 and R25, and asserts the signal /28V FAIL when the 28 volt supply is determined to have failed. Likewise, comparator U3 monitors the health of the supply voltage VCC by comparing node 326 against the 2.5 volt reference provided by Zener diode U4.

Fuses F1 and F2 are provided for the protection of the solenoids SOL2 and SOL1 in the situation where an operator depresses and holds the manual release pushbutton SW4, which uses the 24 volt vehicle battery source to actuate the solenoids of the valves. The energy provided by energy storage capacitors C3 and C10 is of limited duration, but an operator might depress the manual release pushbutton SW4 for an extended period of time, which might cause the solenoids to burn out.

Brown et al., U.S. Pat. No. 6,184,980 (issued Feb. 6, 2001), fully included herein by reference, discloses a well-known fiber optic sensor that detects and identifies petroleum. Modification of the thermopile input section of the sensor module 282 of the present invention by replacement with the well-known petroleum detector 350 disclosed in the Brown et al. patent enables the present invention to be used in remote locations such as fuel farms, well heads, and petroleum transmission pipes, and the valve of the present invention can then discharge from the tank a fire suppressant or petroleum containment and amelioration agent for the detected hazard. A block diagram of the present invention 250A adapted with such a well-known chemical sensor for sensing a molecule species is shown in FIG. 35. In such an application of the present invention, the operator's panel 268" would have a "HAZARD" indicator in place of the "FIRE" indicator, using a detection signal from the sensor.

Tapalian et al., U.S. Pat. No. 6,657,731 (issued Dec. 2, 2003), fully included herein by reference, discloses a well-known miniaturized high-resolution chemical sensor using a waveguide-coupled microcavity optical resonator for sensing a molecule species that has applicability in the fields of manufacturing process control, environmental monitoring, and chemical agent sensing on the battlefield. Modification of the thermopile input section of the sensor module 282 of the present invention by replacement with the well-known high-resolution chemical sensor with microcavity optical resonator 352 disclosed in the Tapalian patent enables the present invention to be used in process control, environmental monitoring, and chemical agent and other biological hazard sensing on the battlefield, and the valve of the present invention can then discharge from the tank a suppressant or antidote for the detected hazard. A block diagram of the present invention 250B adapted with such a well-known chemical sensor for sensing a molecule species is shown in FIG. 36. In such an application of the present invention, the operator's panel 268" would have a "HAZARD" indicator in place of the "FIRE" indicator, using a detection signal from the sensor.

van de Berg et al., U.S. Pat. No. 6,832,507 (issued Dec. 21, 2004), fully included herein by reference, discloses a sensor for detecting the presence of moisture, and uses a transmitter-receiver for generating an electromagnetic interrogation field. Modification of the thermopile input section of the sensor module 282 of the present invention by replacement with the well-known moisture detector 354 disclosed in the van de Berg et al. patent enables the present invention to be used for moisture detection in applications where control of moisture is critical, and the valve of the present invention can then discharge from the tank a drying agent to control the detected moisture hazard. A block diagram of the present invention 250C adapted with such a well-known moisture detector is shown in FIG. 37. In such an application of the present invention, the operator's panel 268"' would have a "MOISTURE" indicator in place of the "FIRE" indicator, using a detection signal from the sensor.

Bordynuik, U.S. Pat. No. 7,115,872 (issued Oct. 3, 2006), fully included herein by reference, discloses a well-known radiation detector for dirty bomb and lost radioactive source detection applications. The detector combines indirect radiation detection using a scintillator and photodiode and direct radiation detection by placing the photodiode and a high gain amplifier in the path of radiation, and generates an alarm that indicates the presence of radiation. Modification of the thermopile input section of the sensor module 282 of the present invention by replacement with the well-known radiation detector 356 disclosed in the Bordynuik patent enables the present invention to be used for radiation detection, and the valve of the present invention can then discharge from the tank a suppressant or antidote for the detected hazard. A block diagram of the present invention 250D adapted with such a well-known radiation detector is shown in FIG. 38. In such an application of the present invention, the operator's panel 268" would have a "HAZARD" indicator in place of the "FIRE" indicator, using a detection signal from the sensor.

Tice, U.S. Pat. No. 7,232,512 (issued Jun. 19, 2007), discloses a well-known system and method for sensitivity adjustment for an electrochemical sensor to detect gasses including carbon monoxide, carbon dioxide, propane, methane, and potentially-explosive gases. Modification of the thermopile input section of the sensor module 282 of the present invention by replacement with the well-known gas sensor 358 disclosed in the Tice patent enables the present invention to be used for detection of gasses, and the valve of the present invention can then discharge from the tank a suppressant or antidote or neutralizing agent for the detected hazard. A block diagram of the present invention 250E adapted with such a well-known gas sensor is shown in FIG. 39. In such an application of the present invention, the operator's panel 268" would have a "HAZARD" indicator in place of the "FIRE" indicator, using a detection signal from the sensor.

Takayasu, et al., U.S. Pat. No. 7,242,789 (issued Jul. 10, 2007), discloses a well-known image sensor that detects a moving body, and provides a movement direction and speed of a moving body that moves between two photodetector stations. Modification of the thermopile input section of the sensor module 282 of the present invention by replacement with the well-known moving body detector 360 disclosed in the Takayusu, et al., patent enables the present invention to be used for passively detecting movement of a person or vehicle in a combat environment and cause a valve of the present invention to discharge a non-hazardous chemical marking agent to mark the person or vehicle for subsequent detection. Suspected persons or vehicles that have been so marked subsequently could be readily identified using a non-invasive detector such as ultraviolet light that would cause a marked target to glow when illuminated by the ultraviolet light, thereby permitting positive identification of the person or vehicle. By dispensing of a time-queued combination of marking chemicals, the person or vehicle could be identified as to the time and location that the marking discharge occurred. A block diagram of the present invention 250F adapted with such a well-known moving body detector is shown in FIG. 40. In such an application of the present invention, the operator's panel 268"" would have a "MOVEMENT" indicator in place of the "FIRE" indicator, using a detection signal from the sensor.

Although the present invention has been described and illustrated with respect to a preferred embodiment and a preferred use therefor, it is not to be so limited since modifications and changes can be made therein which are within the full intended scope of the invention.

We claim:

1. A hazard detection and suppression apparatus comprising:

(a) a single-action discharge valve for discharging the contents of a vessel, said valve comprising:

i. a valve body having a passage therethrough through which said contents are discharged, said passage having a perimeter thereabout and having a substantially constant cross-section area, and said passage having a center;

ii. a frangible seal held within said valve body and sealing said passage while said seal is intact;

iii. a solenoid for selective connection to a power source for selective actuation thereby, said solenoid including an armature substantially exterior of said passage and movable from a first position to a second position, with substantially all of said passage passing axially through said armature, said passage having a substantially constant cross-section area from said frangible seal through said substantially all of said passage passing axially through said armature; and iv. impacting means for impacting said seal remote from said center of said passage and proximate said perimeter of said passage and for breaking said seal into at least two pieces, said impacting means being moved by said armature to break said seal as said armature moves into said second position;

(b) an electrical power source;

(c) control means interposed between said valve and said electrical power source for selective connection of said electrical power source to said valve; and (d) a hazard detector for detecting a hazard, said hazard detector being operably connected to said control means; said control means being responsive to detection of said hazard by said hazard detector by connecting said electrical power source to said valve.

2. The hazard detection and suppression apparatus as recited in claim 1, in which said hazard detector comprises:

(a) an infrared sensor responsive to optical energy in the range of about 0.2 microns to 10 microns; and (b) a temperature sensor responsive to temperatures above a certain predetermined temperature.

3. The hazard detection and suppression apparatus as recited in claim 2, in which said hazard detector further comprises a pushbutton.

4. The hazard detection and suppression apparatus as recited in claim 1, in which said hazard detector comprises a petroleum detector.

5. The hazard detection and suppression apparatus as recited in claim 1, in which said hazard detector comprises a chemical sensor.

6. The hazard detection and suppression apparatus as recited in claim 1, in which said hazard detector comprises a moisture detector.

7. The hazard detection and suppression apparatus as recited in claim 1, in which said hazard detector comprises a radiation detector.

8. The hazard detection and suppression apparatus as recited in claim 1, in which said hazard detector comprises a gas sensor.

9. The hazard detection and suppression apparatus as recited in claim 1, in which said hazard detector comprises a moving body sensor.

10. The hazard detection and suppression apparatus as recited in claim 9, in which said the contents of said vessel include a chemical marking agent.

11. The hazard detection and suppression apparatus as recited in claim 1, in which said impacting means comprises a plurality of pins mounted for impacting reciprocation within said valve body against said seal by said armature as said armature moves from said first position to said second position.

12. The hazard detection and suppression apparatus as recited in claim 1, in which said impacting means comprises a plurality of teeth mounted for mutual reciprocation with said armature and depending therefrom toward said seal so as to impactingly strike said seal as said armature moves from said first position to said second position.

* * * * *

UNITED STATES PATENT AND TRADEMARK OFFICE

CERTIFICATE OF CORRECTION

PATENT NO. : 7,740,081 B2
APPLICATION NO. : 11/879328
DATED : June 22, 2010
INVENTOR(S) : Richard H. Edwards et al.

It is certified that error appears in the above-identified patent and that said Letters Patent is hereby corrected as shown below:

On the title page, item (74) ("Attorney, Agent, or Firm"), change the listed Firm name from
"McKenzie & Walker, P.C."
to
--Walker, McKenzie & Walker, P.C--.

Signed and Sealed this

Twenty-fourth Day of August, 2010

David J. Kappos

David J. Kappos
*Director of the United States Patent and Trademark Office*